US007380462B2

(12) United States Patent
Choi et al.

(10) Patent No.: US 7,380,462 B2
(45) Date of Patent: Jun. 3, 2008

(54) APPARATUS AND METHOD FOR MEASURING SUPPORTING FORCE OF LARGE DIAMETER FERROCONCRETE PILES

(75) Inventors: Yong-Kyu Choi, 105-1002 Beach Apt., Namchun-dong, Suyoung-gu, Pusan-gwangyuksi (KR); Min-Hee Lee, 36-3 Bukjung-dong, Jung-gu, Wulsan-gwangyuksi (KR)

(73) Assignees: G-Tech. Co., Ltd., Pusan-Gwangyuksi (KR); Yong-Kyu Choi, Pusan-Gwangyuksi (KR); Min-Hee Lee, Wulsan-Gwangyuksi (KR)

( * ) Notice: Subject to any disclaimer, the term of this patent is extended or adjusted under 35 U.S.C. 154(b) by 138 days.

(21) Appl. No.: 11/373,328

(22) Filed: Mar. 13, 2006

(65) Prior Publication Data

US 2006/0213279 A1 Sep. 28, 2006

(30) Foreign Application Priority Data

Mar. 25, 2005 (KR) ..... 10-2005-0024741
Jun. 23, 2005 (KR) ..... 10-2005-0054235
Nov. 15, 2005 (KR) ..... 10-2005-0109369
Nov. 15, 2005 (KR) ..... 10-2005-0109370

(51) Int. Cl.
*E02D 5/00* (2006.01)

(52) U.S. Cl. ..... 73/786; 73/784; 73/788; 73/803; 73/820; 405/233

(58) Field of Classification Search ..... 73/784, 73/786, 788, 803, 820; 405/233
See application file for complete search history.

(56) References Cited

U.S. PATENT DOCUMENTS 2,957,341 A * 10/1960 Menard ..... 73/84
4,458,525 A * 7/1984 Lutenegger et al. ..... 73/84
4,614,110 A * 9/1986 Osterberg ..... 73/84
5,351,865 A * 10/1994 Szadkowski et al. ..... 222/607
5,377,548 A * 1/1995 Ballivy ..... 73/768

(Continued)

FOREIGN PATENT DOCUMENTS

KR 10-2005-0002682 1/2005

*Primary Examiner*—Edward Leekowitz
*Assistant Examiner*—Freddie Kirkland, III
(74) *Attorney, Agent, or Firm*—Robert E. Bushnell, Esq.

(57) ABSTRACT

An apparatus measures a supporting force of ferroconcrete piles by means of a bi-directional front end oil pressure loading apparatus using a high pressure loading system capable of measuring a supporting force, a sinking amount and an axis load distribution on the ferroconcrete piles. The apparatus comprises: a steel plate having a predetermined thickness and diameter and including upper and lower discs having penetration holes through which concrete passes; a fixing member for separating the discs from each other by a predetermined distance; a high oil pressure cylinder for producing an oil pressure force; an oil cylinder inflation displacement measuring sensor for measuring a displacement; an upper displacement measuring rod coupled to the upper disc for measuring a displacement of the upper disc; a lower displacement measuring rod coupled to the upper disc for measuring a displacement of the lower disc; an axis load transition measuring instrument including a tremie induction tube coupled to the upper disc for guiding concrete to the penetration holes; iron elements coupled to the upper disc; a load sensor for measuring ground abrasion; and a sensor line for transferring a signal and current to the load sensor. A corresponding method is disclosed.

17 Claims, 26 Drawing Sheets

U.S. PATENT DOCUMENTS 5,576,494 A 11/1996 Osterberg
6,371,698 B1 * 4/2002 Beck et al. ..... 405/236
6,869,255 B1 * 3/2005 Beck et al. ..... 405/233
6,942,429 B1 * 9/2005 Beck et al. ..... 405/236

* cited by examiner

APPARATUS AND METHOD FOR MEASURING SUPPORTING FORCE OF LARGE DIAMETER FERROCONCRETE PILES

CLAIMS OF PRIORITY

This application makes reference to, incorporates the same herein, and claims all benefits accruing under 35 U.S.C. §119 from applications entitled APPARATUS FOR MEASURING SUPPORTING FORCE OF LARGE DIAMETER FERROCONCRETE PILES INSTALLED ON SCENE BY MEANS OF BI-DIRECTIONAL FRONT END OIL PRESSURE LOADING APPARATUS USING HIGH-PRESSURE LOADING SYSTEM AND METHOD THEREOF, earlier filed in the Korean Intellectual Property Office on 25 Mar. 2005 and 23 Jun. 2005 and there, duly assigned Serial Nos. 10-2005-0024741 and 10-2005-0054235, respectively, and applications bearing the aforesaid title of the invention, earlier filed in the Korean Intellectual Property Office on 15 Nov. 2005 and there, duly assigned Ser. Nos. 10-2005-0109369 and 10-2005-109370.

BACKGROUND OF THE INVENTION

1. Technical Field

This invention relates to an apparatus and method for measuring a supporting force of large diameter ferroconcrete piles installed at a scene by means of a bi-directional front end oil pressure loading apparatus using a high pressure loading system capable of measuring supporting force, sinking amount, and axis load distribution on ferroconcrete piles installed at the scene, the ferroconcrete piles being used as base piles in the fields of public engineering and the construction industry.

2. Related Art

In a method for determining the vertically limited supporting force of piles, the following are employed: a static post loading test, a static and dynamic loading test, a dynamic loading test, a static mechanical supporting force formula, an experience formula such as a scene test result, a wave equation, an assumption like a post analysis code, and an assumption like a continuous body analysis. High reliance is placed on the static post loading test.

The static post loading test is a generic form of testing, and is used when upper architecture is constructed with the application of a real load to a post. Thus, it has a high degree of reliability.

In the above described static post loading test, however, methods of establishing pressurization and a reaction system and a spacious test lot are required for the purpose of applying a load, resulting in many requirements such as air conditioning, maintenance of the condition of the scene, and the like.

In addition, if the supporting force is smaller than a required value due to an operational defect because a load to be imposed on one post is very heavy, the entire construction can be adversely affected in view of utility and stability of a large diameter post.

Furthermore, ground is excavated at the scene, and then concrete is poured into the excavation and recuperated. This recuperation causes the supporting force of a post installed at the scene to be able to be largely changed, depending on departures from working procedures or an undesirable change in ground condition.

Therefore, it is impossible for a designer to avoid implementing a conservative layout when a load is used and laid out with its value assumed and tolerated on the basis of ground conditions, thereby amounting to a considerable consumption of a natural resource.

To solve the above described problems, U.S. Pat. No. 5,576,494 discloses an apparatus for measuring a supporting load using an Osterberg cell, in which a high oil pressure jack is installed in a post, and a reaction against the application of a load by a front end supporting force and a main abrasion generated from loading is produced. As a result, there is no requirement for a static post loading test or for separate load applying apparatus and reaction equipment, resulting in the ability to operate in a narrow test space or at a tilted location.

Such a supporting load apparatus using an Osterberg cell, as described in U.S. Pat. No. 5,576,494, was developed in the 1980's, and comprises flat upper and lower discs, a cylinder having a piston contacting the bottom of the flat upper disc and a body contacting the top of the flat lower disc, a connection member coupled to the upper and lower discs by welding both ends to the bottom of the upper disc and the top of the lower disc, respectively, and a displacement unit for measuring a displacement of the upper and lower discs.

In such an apparatus for measuring a supporting load using an Osterberg cell, substrate concrete to be poured to the bottom is recuperated so that the substrate concrete may have a rigidity stronger than a predetermined value before an Osterberg cell is safely received, and more concrete is poured so that concrete piles are formed after the completion of the safe receipt of the Osterberg cell. As a result, it takes a long time to measure a supporting load.

Although the substrate concrete and the additional concrete are the same in view of their materials, they have a different solidity because their pouring times and recuperating times are different.

Accordingly, concrete piles to be used in a laboratory experiment are different from those used in a working environment in view of front end supporting force and column face abrasion, which results in a problem in terms of degraded reliability in such an apparatus for measuring a supporting load using an Osterberg cell.

In addition, such an apparatus for measuring a supporting load using an Osterberg cell has a flaw in that only a load for supporting non-iron concrete piles can be measured, whereas the concrete piles utilized at a working scene are concrete piles with iron built in.

To solve the disadvantages contained in U.S. Pat. No. 5,576,494, Korean Patent Laid-Open Publication No. 10-2005-0002682 discloses an apparatus for measuring a supporting load which comprises upper and lower discs, a cylinder coupled between the discs, a front end force measuring instrument including a displacement measuring rod for measuring displacement of the discs, iron elements coupled to the top of the front end force measuring instrument, and an axis load transition measuring instrument for measuring ground abrasion with coupling to the iron elements.

Such an apparatus for measuring a supporting load has deficiency in that the size of basis piles is limited and the number of oil pressure cylinders is unlimited, with the result that such an apparatus is not adopted for a necessary loading capacity.

In addition, the increased number of oil pressure cylinders makes it difficult to equally adjust oil amount, and therefore it is difficult to accurately adjust a load to be tested.

SUMMARY OF THE INVENTION

Accordingly, it is a primary object of this invention to provide an apparatus for measuring a supporting force of large diameter ferroconcrete piles installed at a scene by means of a bi-directional front end oil pressure loading apparatus using a high pressure loading system capable of reducing the number of oil pressure cylinders required for a predetermined loading capacity, thereby solving problems relating to arrangement of oil pressure cylinders and adjustment of low oil pressure supplied to a respective oil pressure cylinder. A second object of the present invention is to provide an apparatus for measuring a supporting force of large diameter ferroconcrete piles, which may remove a remaining space generated from the interior of a double-action high pressure jack by causing a stroke of the double-action high pressure jack, which is projected to the exterior, to be restored to its original state, using the double-action high pressure jack and a stroke restoring oil hose.

An additional object of this invention is to provide an apparatus for measuring a supporting force of large diameter ferroconcrete piles installed at a scene by means of a bi-directional front end oil pressure loading apparatus using a high pressure loading system capable of having a high loading capacity and an economic manufacturing cost, and capable of obtaining protection from eccentricity in loading and working convenience with adjustment of a hollowed diameter, and capable of being applied to middle and small diameter piles installed at the scene, and loading closed piles and buried piles, in addition to the large diameter piles installed at the scene.

A further object of this invention is to provide an apparatus for measuring a supporting force of large diameter ferroconcrete piles installed at a scene by means of a bi-directional front end oil pressure loading apparatus using a high pressure loading system capable of removing a remaining space generated from the interior of an oil pressure cylinder by causing a stroke of the oil pressure cylinder, which is projected to the exterior, to be restored to its original state, using a single-action oil pressure cylinder after completion of a test.

Another object of this invention is to provide an apparatus for measuring a supporting force of large diameter ferroconcrete piles installed at a scene by means of a bi-directional front end oil pressure loading apparatus using a high pressure loading system capable of implementing a method for writing a respective axis load distribution chart when pile loading test equipment is installed on the front end of piles, and when the pile loading test equipment is installed on the median of piles.

A further object of this invention is to provide an apparatus for measuring a supporting force of large diameter ferroconcrete piles installed at a scene by means of a bi-directional front end oil pressure loading apparatus using a high pressure loading system having a displacement measuring rod capable of reducing weight using stainless materials and conveniently adhering by means of a one-touch connection method.

According to another aspect of the present invention, an apparatus for measuring supporting force of large diameter ferroconcrete piles installed at a scene by means of a bi-directional front end oil pressure loading apparatus using a high pressure loading system comprises: a loading apparatus comprising a wholly circle-shaped steel plate having a predetermined thickness and diameter, and including a pair of upper and lower discs having plural ready mixed concrete penetration holes so that concrete may be passed through, a fixing member for causing the discs to be fixed separately from each other at a predetermined distance, a high oil pressure cylinder for producing an oil pressure force, and an oil cylinder inflation displacement measuring sensor installed adjacent to the high oil pressure cylinder for measuring displacement; a displacement measuring rod including an upper displacement measuring rod which is coupled perpendicularly to the top of the upper disc for measuring displacement of the upper disc, an upper displacement measuring rod casing for containing the upper displacement measuring rod, a lower displacement measuring rod coupled perpendicularly to the top of the upper disc for measuring displacement of the lower disc, and a lower displacement measuring rod casing for containing the lower displacement measuring rod; an axis load transition measuring instrument including a tremie induction tube fixedly coupled to the top of the upper disc to guide concrete to the penetration hole; plural iron elements coupled perpendicularly to the top of the upper disc, an axis load sensor for the iron elements and a sister bar for concrete which is coupled to the exterior of the iron elements for measuring ground abrasion, and a sensor electric line for transferring a signal and a current to the axis load sensor for iron elements and the sister bar for concrete, simultaneously with being coupled with a spare part having a predetermined length so that a disconnection will not be carried out by its extension; and an automatic measuring system which displays and stores measured data from the axis load sensor for iron and the sister bar for concrete.

According to a further aspect of the present invention, a supporting force measuring method using an apparatus for measuring a supporting force of large diameter ferroconcrete piles installed at a scene by means of a bi-directional front end oil pressure loading apparatus using a high pressure loading system comprises the steps of: excavating the ground and forming a hole so that the excavated hole has a predetermined size and depth, the hole being downwardly and perpendicularly created and formed in the ground; installing the supporting force measuring apparatus in the excavated hole; inserting a tremie tube so that the loading apparatus of the supporting force measuring apparatus can penetrate through the tremie tube; pouring the concrete into the tremie tube, the concrete being poured into the ready mixed concrete penetration holes via a tremie induction tube positioned at the lower end of the tremie tube; driving the loading apparatus so that the high oil pressure cylinder is inflated when the concrete is recuperated; measuring displacement at the upper and lower side faces of the loading apparatus using the displacement measuring rod after the inflation of the high oil pressure cylinder and abrasion of the ground contacting the concrete using the axis load transition measuring instrument; and writing an axis load distribution chart with the measured abrasion.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 21A to FIG. 21D represent writing methods relating to axis load distribution for use when double-action hollowed bi-directional test equipment using a high-pressure jack is established between piles, wherein FIG. 21A is a graph showing column face abrasion, FIG. 21B a graph showing upward/downward displacement-one direction load, FIG. 21C is a graph showing abrasion distribution, and FIG. 21D is a graph showing axis load distribution;

DETAILED DESCRIPTION OF THE INVENTION

To fully understand the many objects to be accomplished by various embodiments and operational advantages of this invention, preferred embodiments of this invention will be explained with reference to the attached drawings.

Figure 1:
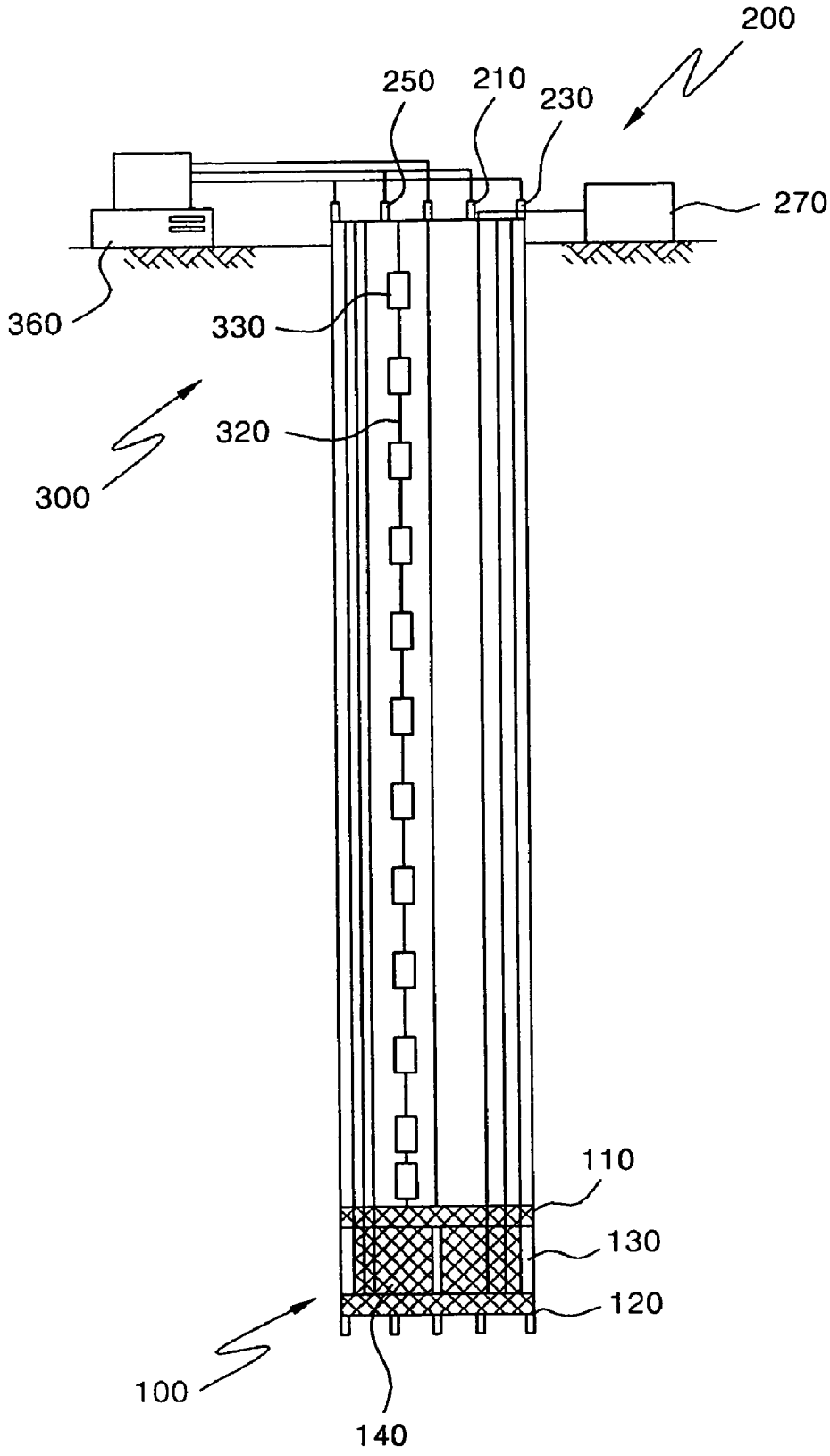
FIG. 1 is an exemplary view showing an apparatus for measuring a supporting force of ferroconcrete piles according to this invention.
Figure 2:
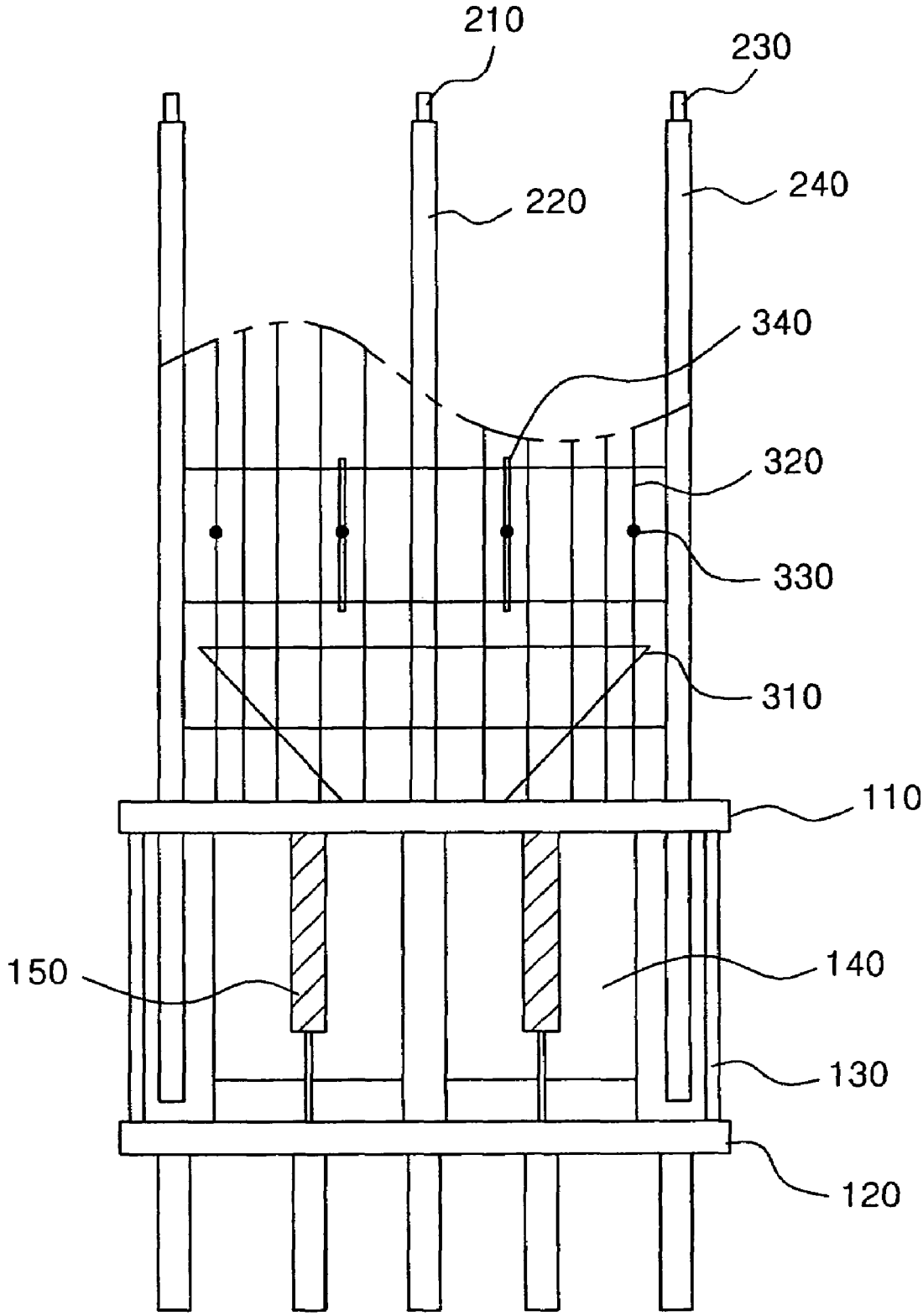
FIG. 2 is an enlarged front view showing a lower portion of FIG. 1.
Figure 3:
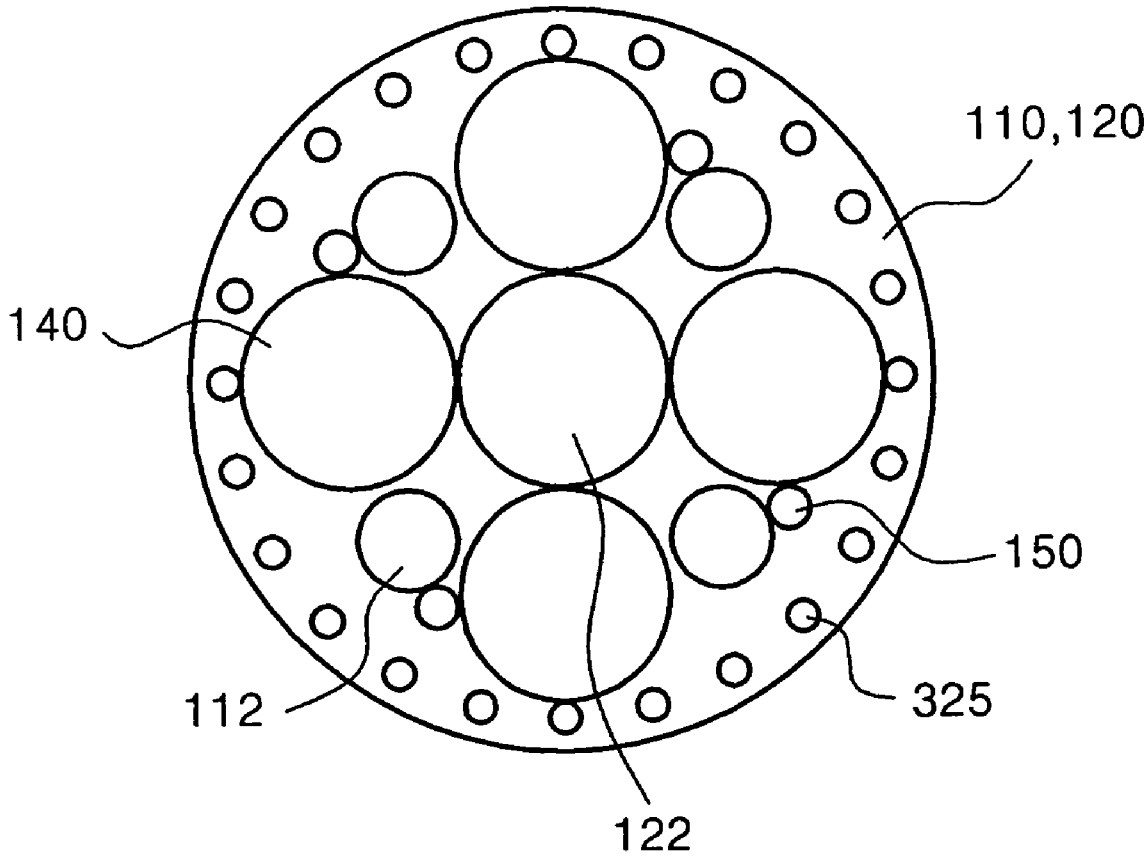
FIG. 3 is a plan view showing the lower portion of FIG. 1.
Figure 4:
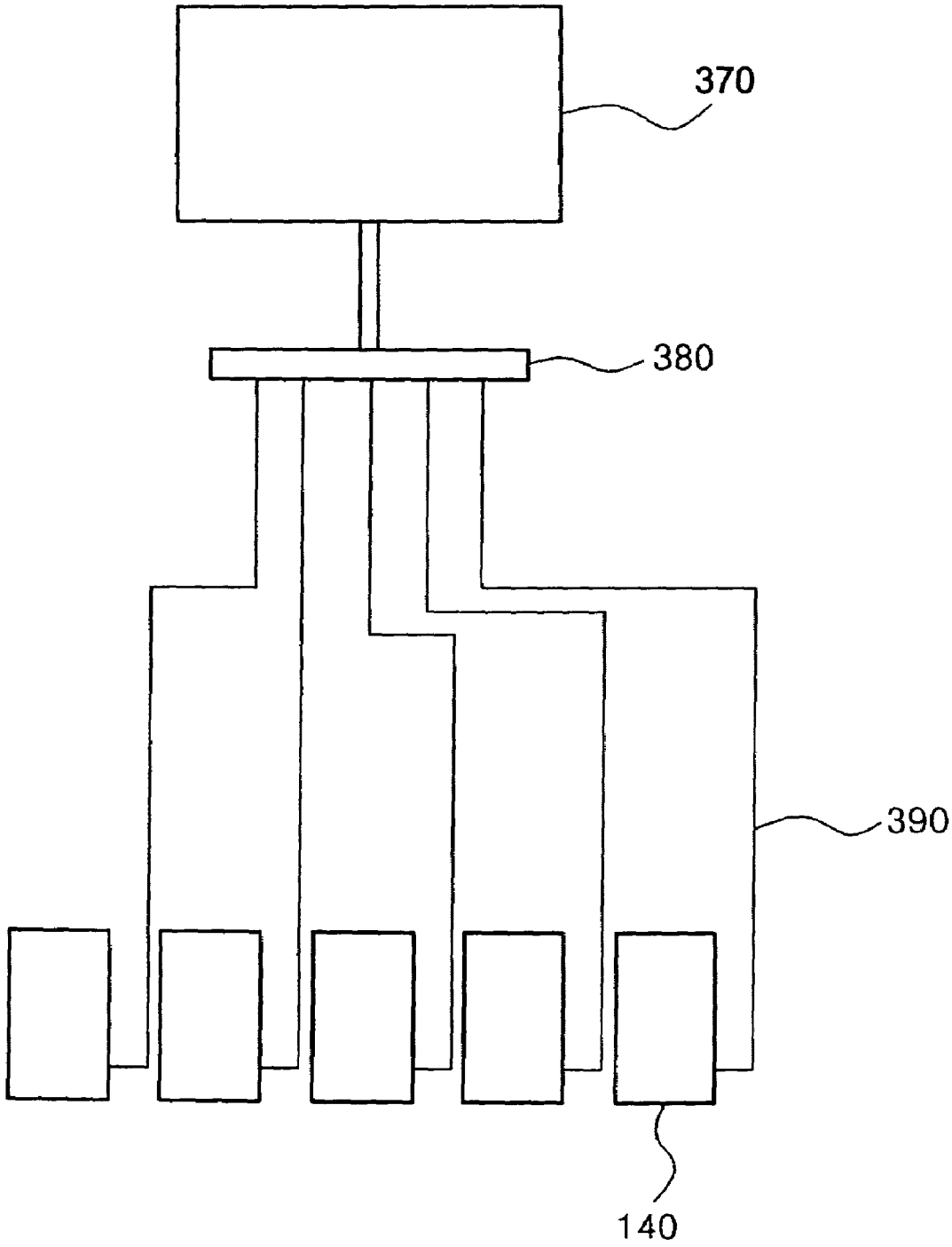
FIG. 4 is a schematic view showing a coupling state of an oil pressure cylinder in the course of loading.
Figure 5:
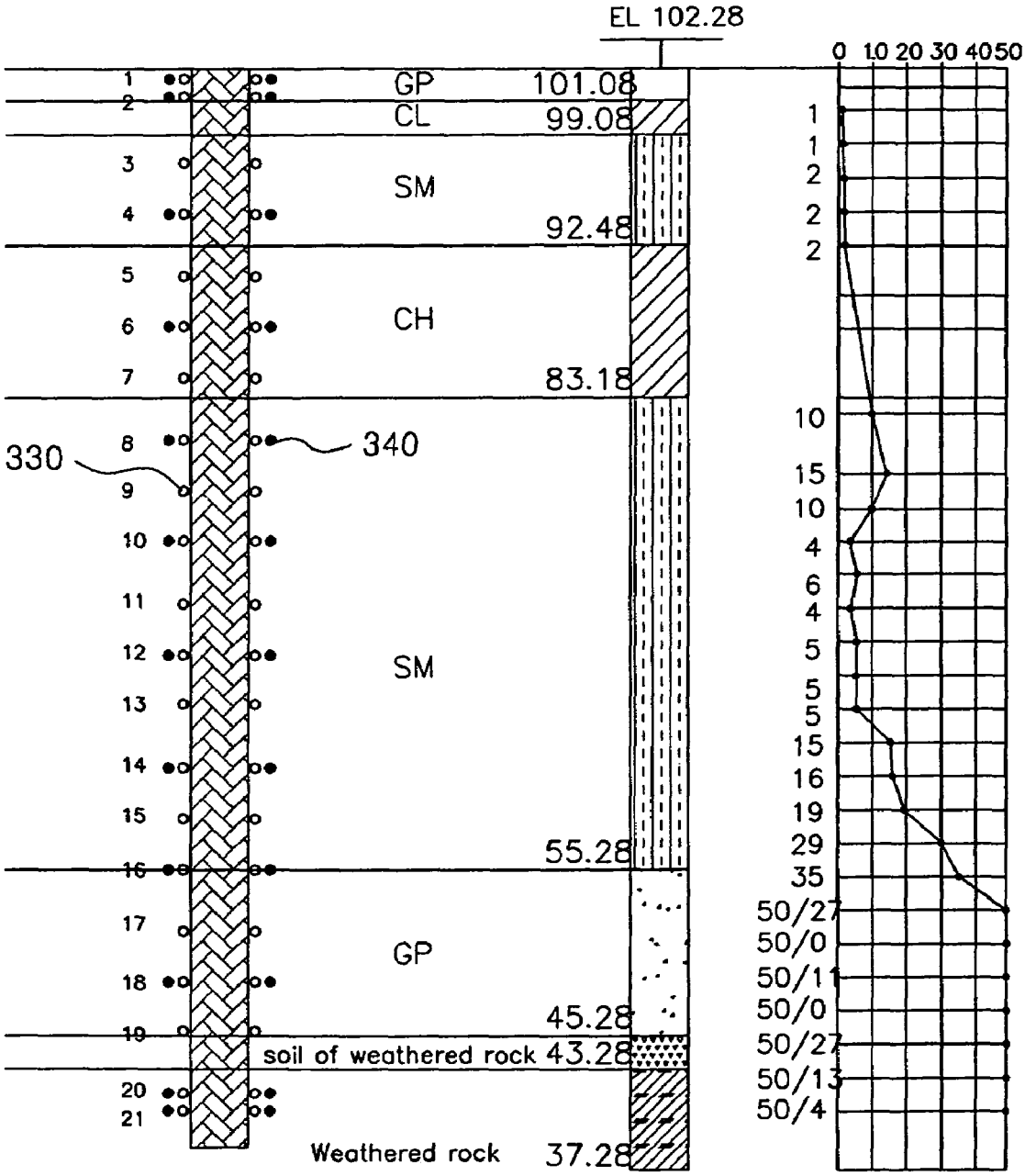
FIG. 5 is a layout view showing an arrangement of sensors for measuring abrasion stress for every stratum.
Figure 6:
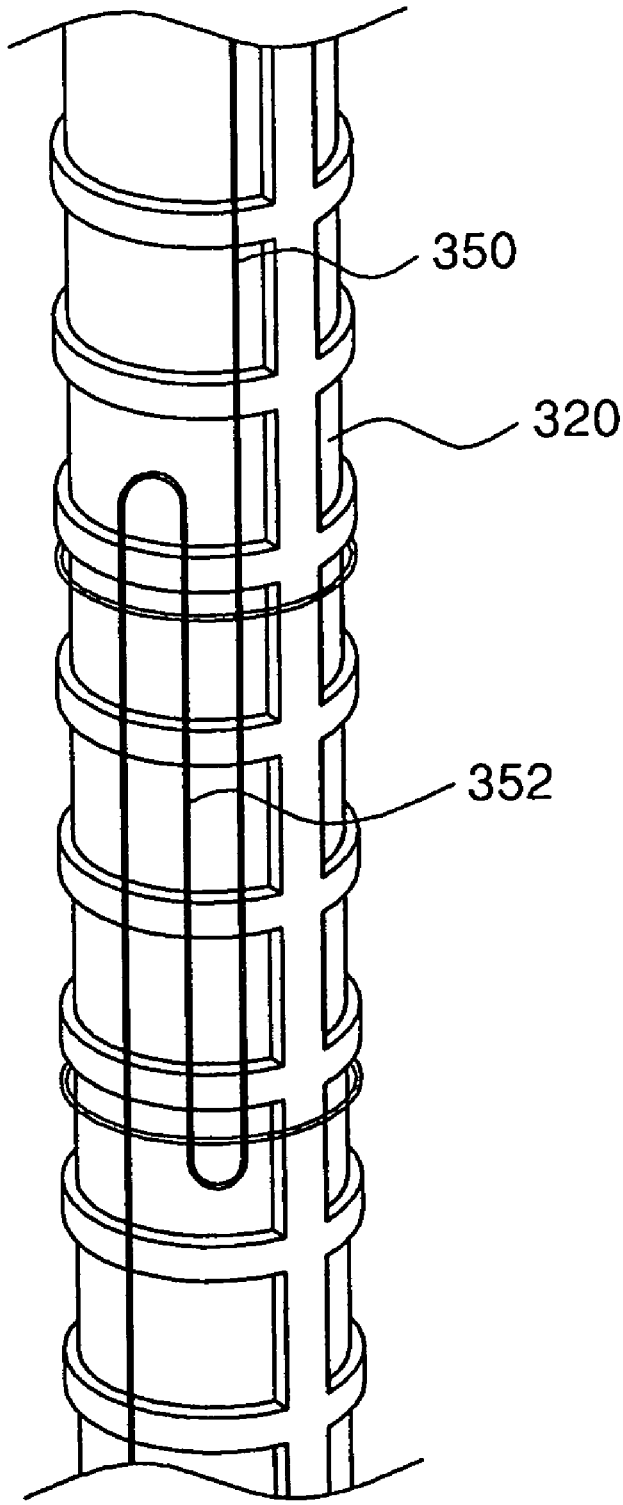
FIG. 6 is an exemplary view showing adherence of a sensor electric line to iron.
Figure 7:
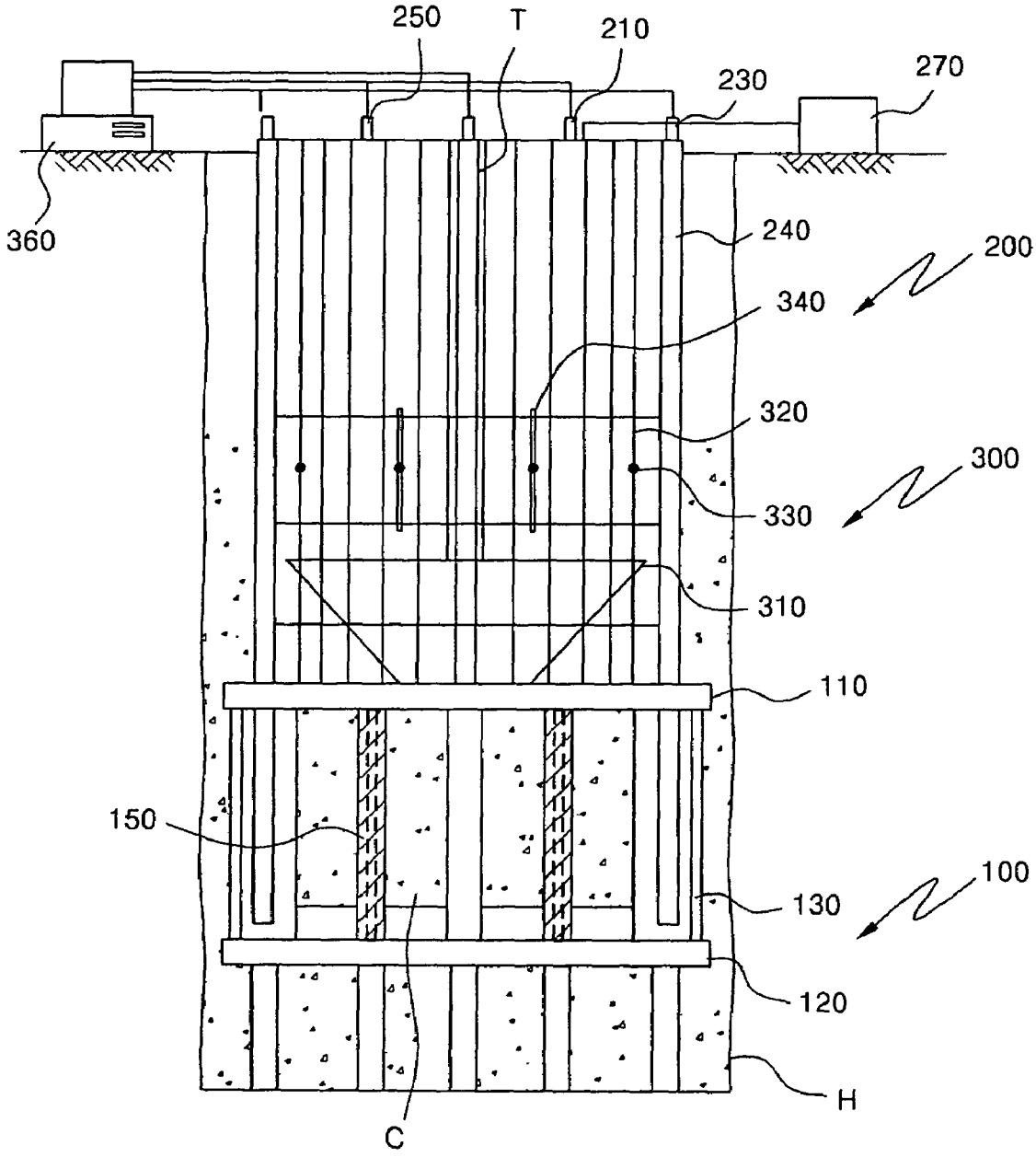
FIG. 7 is an exemplary view showing establishment of a supporting force measuring apparatus.
Figure 8A:
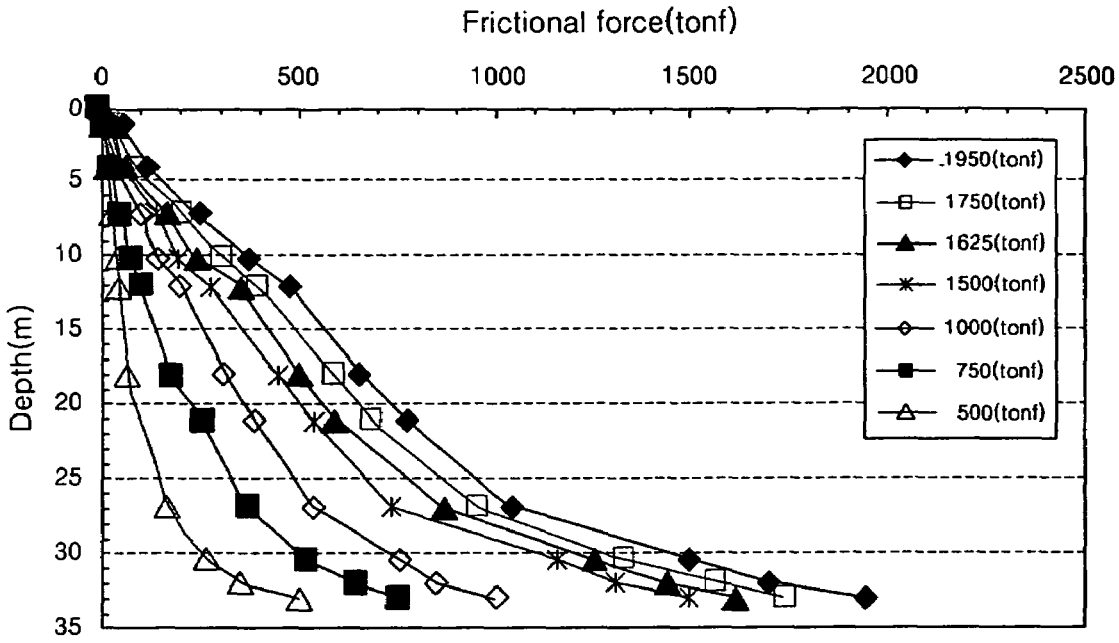
FIG. 8A is a graph showing an abrasion distribution at a column face with every step of a measured load.
Figure 8B:
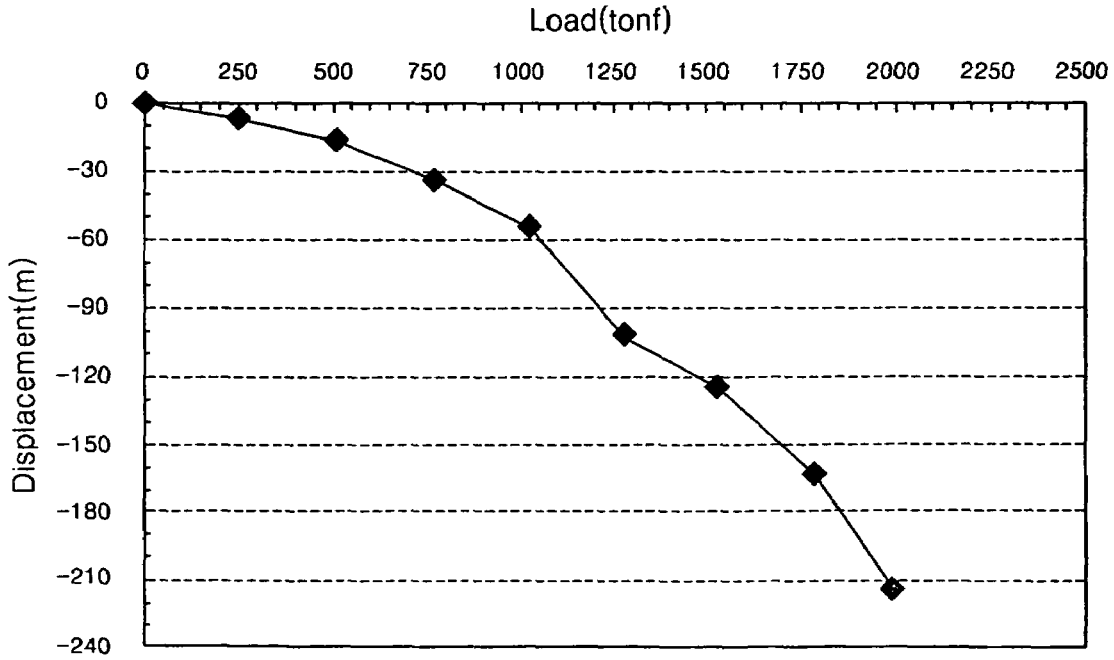
FIG. 8B is a graph showing a front end load.
Figure 8C:
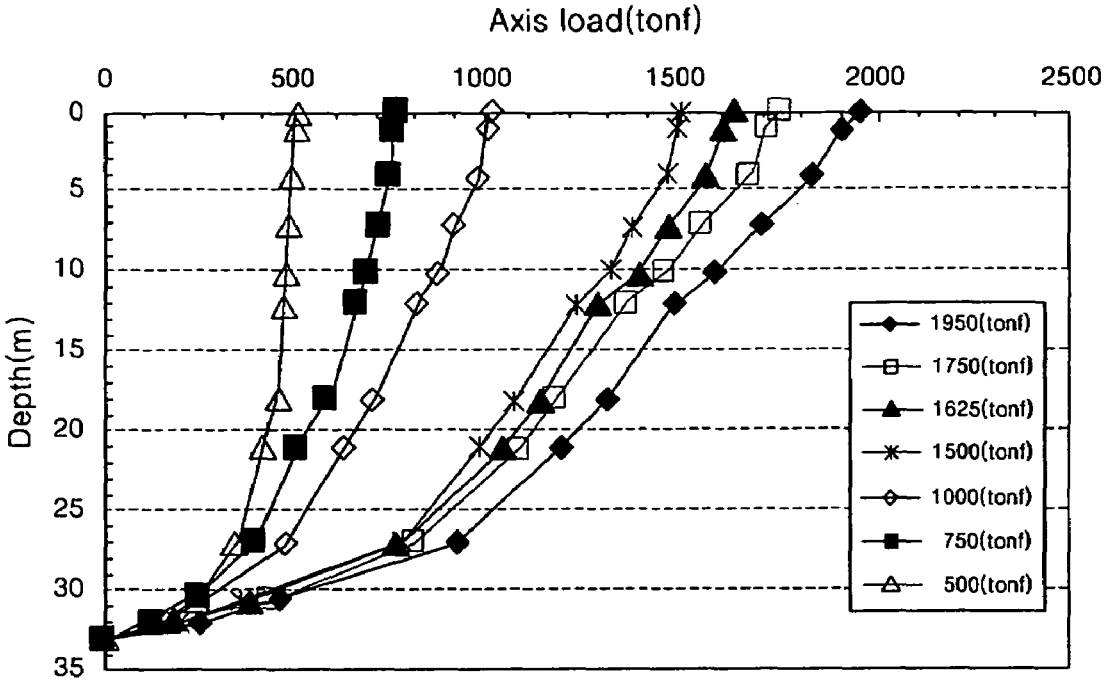
FIG. 8C is a graph showing an abrasion distribution at a column face with every step of a measured load changed in the case of head loading.
Figure 8D:
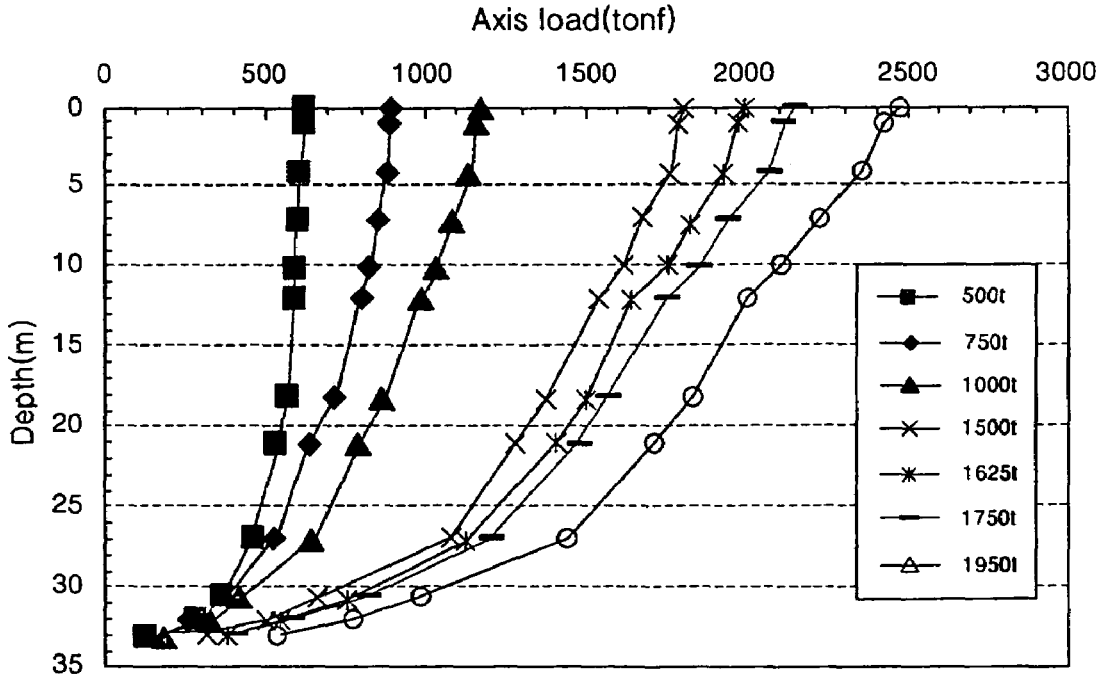
FIG. 8D is a graph showing an axis load distribution.

FIG. 1 is an exemplary view showing an apparatus for measuring a supporting force of large diameter ferroconcrete piles installed at a scene by means of a bi-directional front end oil pressure loading apparatus using a high pressure loading system according to this invention, FIG. 2 is an enlarged front view showing a lower portion of FIG. 1, FIG. 3 is a plan view showing the lower portion of FIG. 1, FIG. 4 is a schematic view showing a coupling state of an oil pressure cylinder in the course of loading, FIG. 5 is a layout view showing an arrangement of sensors for measuring abrasion stress for every stratum, FIG. 6 is an exemplary view showing adherence of a sensor electric line to iron, FIG. 7 is an exemplary view showing establishment of a supporting force measuring apparatus, FIG. 8A is a graph showing an abrasion distribution chart at a column face with every step of a measured load, FIG. 8B is a graph showing a front end load, FIG. 8C is a graph showing an abrasion distribution chart at a column face for every step of a measured load changed in the case of head loading, and FIG. 8D is a graph showing an axis load distribution chart.

As shown in these drawings, an apparatus for measuring a supporting force of large diameter ferroconcrete piles installed at a scene by means of a bi-directional front end oil pressure loading apparatus using a high pressure loading system according to this invention comprises: a loading apparatus 100 consisting of a circle-shaped steel plate having a predetermined thickness and diameter, and including a pair of upper and lower discs 110 and 120, respectively, having a plurality of ready mixed concrete penetration holes 112 and tremie and ready mixed concrete penetration holes 122 so that concrete may be passed through, a fixing member 130 for separating the discs 110 and 120 from each other at a predetermined distance, a high oil pressure cylinder 140 for producing an oil pressure force, and an oil pressure cylinder inflation displacement measuring sensor 150 installed adjacent to the high oil pressure cylinder 140 for measuring displacement; a displacement measuring rod 200 including an upper displacement measuring rod 210 coupled perpendicularly to the top of the upper disc 110 so as to measure a displacement of the upper disc 110, an upper displacement measuring rod casing 220 for containing the upper displacement measuring rod 210, a lower displacement measuring rod 230 coupled perpendicularly to the top of the lower disc 120 so as to measure displacement of the lower disc 120, and a lower displacement measuring rod casing 240 for containing the lower displacement measuring rod 210; and an axis load transition measuring instrument 300 including a tremie induction tube 310 coupled to the top of the upper disc 110 so as to guide concrete to the ready mixed concrete penetration holes 112, plural iron elements 320 coupled perpendicularly to the top of the upper disc 110, an axis load sensor 330 and sisters bar 340 for coupling to the exterior of the irons 320 and for measuring a ground abrasion, a sensor electric line 350 installed to transfer a signal and a current to the axis load sensor 330 and the sisters bar 340, simultaneously with being coupled with a remaining spare portion 352 having a predetermined length so that a disconnection may not be made by its extension, and an automatic measuring system 360 for displaying and storing measured data from the axis load sensor 330 and the sisters bar 340 for concrete.

In such an apparatus for measuring a supporting force of large diameter ferroconcrete piles installed at a scene by a means of a bi-directional front end oil pressure loading apparatus using a high pressure loading system according to this invention, the loading apparatus 100, the displacement measuring rod 200, and the axis load transition measuring instrument 300 are mutually coupled to each other.

For the purpose of obtaining a necessary loading capacity, which is a problem with a low oil pressure cylinder used to construct a high-pressure loading system using the high oil pressure cylinder 140 and peripheral equipment, the problem of the conventional low oil pressure cylinder, in view of its layout and establishment, must be overcome by reducing the number of low oil pressure cylinders by more than a required number. In addition, the oil amount to be transferred to a respective high oil pressure cylinder 140 must be smoothly adjusted.

The loading apparatus 100 includes the upper and lower discs 110 and 120, respectively, upper and lower fixing member 130, a high oil pressure cylinder 140, and an oil pressure cylinder inflation displacement measuring sensor 150.

At this point, the upper and lower discs 110 and 120, respectively, consist of a circle-shaped steel plate having a predetermined thickness and diameter, and a plurality of ready mixed concrete penetration holes 112 and 122 are formed in the discs 110 and 120 so that concrete may be penetrated through.

Furthermore, the upper and lower fixing member 130 separate the discs 110 and 120 by a certain distance.

In the case of using the above single-action oil pressure cylinder, a stroke of the oil pressure cylinder is not perfectly restored to its original state separately from a pump after completion of a test, and thus there is a problem in terms of forming a separate space in the piles.

In contrast, a double-action oil pressure cylinder overcomes the problem in the single-action oil pressure cylinder so that a stroke of the oil pressure cylinder may be perfectly restored to its original state from the pump after tested.

Therefore, it is more preferable to use the double-action oil pressure cylinder than the single-action oil pressure cylinder.

In addition to the above described construction, the high oil pressure cylinder 140 includes a high oil pressure hoses 390, a distributor 380, a high pressure pump 370, and load and pressure adjusters (not shown).

The high oil pressure cylinders 140 are coupled to the hoses 390, and the distributor 380 of the high pressure pump 370 is coupled to the same hoses 390 as the high oil pressure cylinders 140 so as to adjust the high oil pressure cylinders 140, and respective oil pressures are transferred to the high oil pressure cylinders 140 by coupling the high oil pressure cylinders 140 to the hoses 390.

More preferably explaining the high oil pressure cylinders 140, a predetermined pressure is produced by the high pressure pump 370 and provided to the respective high oil pressure cylinders 140 so as to apply the predetermined pressure to the high oil pressure cylinder 140 via the hoses 390.

At this point, the respective pressures of the oil pressure cylinders 140 must be the same, and also the same as that to be provided by the pump 370.

When increasing the number of hoses 390 as the number of the oil pressure cylinders 140 increases, control under the same pressure is difficult, and there is a problem in terms of reliability in loading since there may be an eccentricity due to a load difference generated by the respective high oil pressure cylinders 140.

Accordingly, a safe and reliable loading can be obtained by reducing the number of hoses 390 because the number of high oil pressure cylinders 140 is reduced.

Also, when the high oil pressure cylinders 140 have a pressure higher than 1000 kgf/cm$^2$, the high oil pressure cylinders 140 can obtain a higher load capacity than that of low oil pressure cylinders for the same cylinder surface.

For example, if the diameter of piles is 1500 mm and the required loading capacity is 6000 tonf, it is impossible to have such an arrangement with low oil pressure cylinders because it is necessary to have ten cylinders in the case of using low oil pressure cylinders having a low pressure of 700 kgf/cm$^2$. However, it is possible to have such an arrangement with high oil pressure cylinders because less than five cylinders are required in the case of using high oil pressure cylinders having a high pressure of 1500 kgf/cm$^2$. Therefore, it is easier to carry out a test for measuring a supporting force.

Consequently, one is able to overcome the limit of a load capacity due to an efficient arrangement of the high oil pressure cylinders 140 about a predetermined surface size of a basic set of piles.

Furthermore, the number of piles is reduced by obtaining a high pile supporting capacity.

In addition, the oil cylinder inflation displacement measuring sensor measures displacement between the upper and lower discs 110 and 120, respectively.

The displacement measuring rod 200 includes the upper displacement measuring rod 210, the upper displacement measuring rod casing 220, the lower displacement measuring rod 230, the lower displacement measuring rod casing 240, and a piles head displacement measuring rod 250.

Here, data measured from the oil cylinder inflation displacement measuring sensor, the upper displacement measuring rod 210, the lower displacement measuring rod 230, and the piles head displacement measuring rod 250 are transferred to the automatic measuring system 360, and are automatically processed and stored.

Accordingly, inflation force of the high oil pressure cylinder 140 is measured by the automatic measuring system 360, and successively the displacement of the upper and lower discs 110 and 120, respectively, is measured, thereby calculating a supporting load of a ground.

The upper and lower displacement measuring rods 210 and 220, respectively, are perpendicularly coupled to the top of the upper disc 110 to measure the displacement on the upper and lower discs 110 and 120, respectively, wherein the upper and lower displacement measuring rod casings 240 and 250, respectively, contain the upper and lower displacement measuring rods 220 and 230, respectively.

The axis load transition measuring instrument 300 includes the irons 320, the axis load sensor 330, the sister bar 340 for concrete, the sensor electric line 350, and the automatic measuring system 360.

A funnel shaped tremie induction tube 310 is coupled to upper disc 110 so that the tremie induction tube 310 guides concrete into the penetration holes 122.

Consequently, concrete C which is flowed into the front end of piles via the tremie induction tube 310 is closely filled up from a side portion to the top of the upper disc 110.

Furthermore, the iron elements 320 are installed in the flowed concrete C to form ferroconcrete piles, and are circularly arranged along the outer circumstances of the top of the upper disc 110, simultaneously with being perpendicularly coupled to the top of the upper disc 110.

The axis load sensor 330 is coupled to the exterior of the iron elements 320, wherein a plural of iron elements are separated vertically from another set by a predetermined distance when a column face abrasion for every ground is calculated.

In addition, the sister bar 340 for concrete is adhered to the iron elements 320 so as to measure the axis load of the concrete C.

The sensor electric line 350 has a spare portion 352 having a predetermined length so that a disconnection may not be made by its extension, the spare part 352 having a S shape or other similar shape. In particular, the sensor electric line 350 is coupled to the automatic measuring system 360, simultaneously with being fixed to the iron elements 320.

Furthermore, the automatic measuring system 360 is a system for displaying and storing measured data from the axis load sensor 330 and the sister bar 340.

Hereinafter, a supporting force measuring method using the apparatus for measuring a supporting force of large diameter ferroconcrete piles installed at a scene by means of bi-directional front end oil pressure loading apparatus using a high pressure loading system according to this invention is explained.

The supporting force measuring method using the apparatus for measuring a supporting force of large diameter ferroconcrete piles installed at a scene by a means of a bi-directional front end oil pressure loading apparatus using a high pressure loading system comprises: excavating the ground and forming a hole H so that the excavation hole H having a predetermined size and depth is excavated downward and perpendicularly, and formed in the ground; installing the supporting force measuring apparatus in the hole H; inserting a tremie tube T so that the loading apparatus 100 of the supporting force measuring apparatus may be penetrated; pouring the concrete C in the tremie tube T so that the concrete C enters the penetration holes 112 via the tremie induction tube 310 positioned at the lower end of the tremie tube T; driving the loading apparatus 100 so that the high oil pressure cylinder 140 is inflated when the concrete C is recuperated; measuring a displacement at the upper and lower side faces of the loading apparatus 100 using the displacement measuring rod 200 after inflation of the high oil pressure cylinder 140 and abrasion of the ground contacted by the concrete C using the axis load transition measuring instrument 300; and writing the axis load distribution chart with the measured abrasion.

Here, the writing of the axis load distribution chart is to measure a transformation rate of a piles member, and to represent the axis load distribution chart by converting the measured transformation rate into an axis load. If this is shown with regard to a representative loading step, the axis load distribution chart is written.

Consequently, the supporting force measuring method comprising the above described steps has the effect of accurately measuring the supporting force of large diameter ferroconcrete piles installed at the scene and the sinking amount.

Hereinafter, various embodiments of an apparatus for measuring supporting forces of large diameter ferroconcrete piles installed at a scene by a means of a bi-directional front end oil pressure loading apparatus using a high pressure loading system and a method thereof according to this invention will be explained in more detail.

EXAMPLE 1

Figure 9:
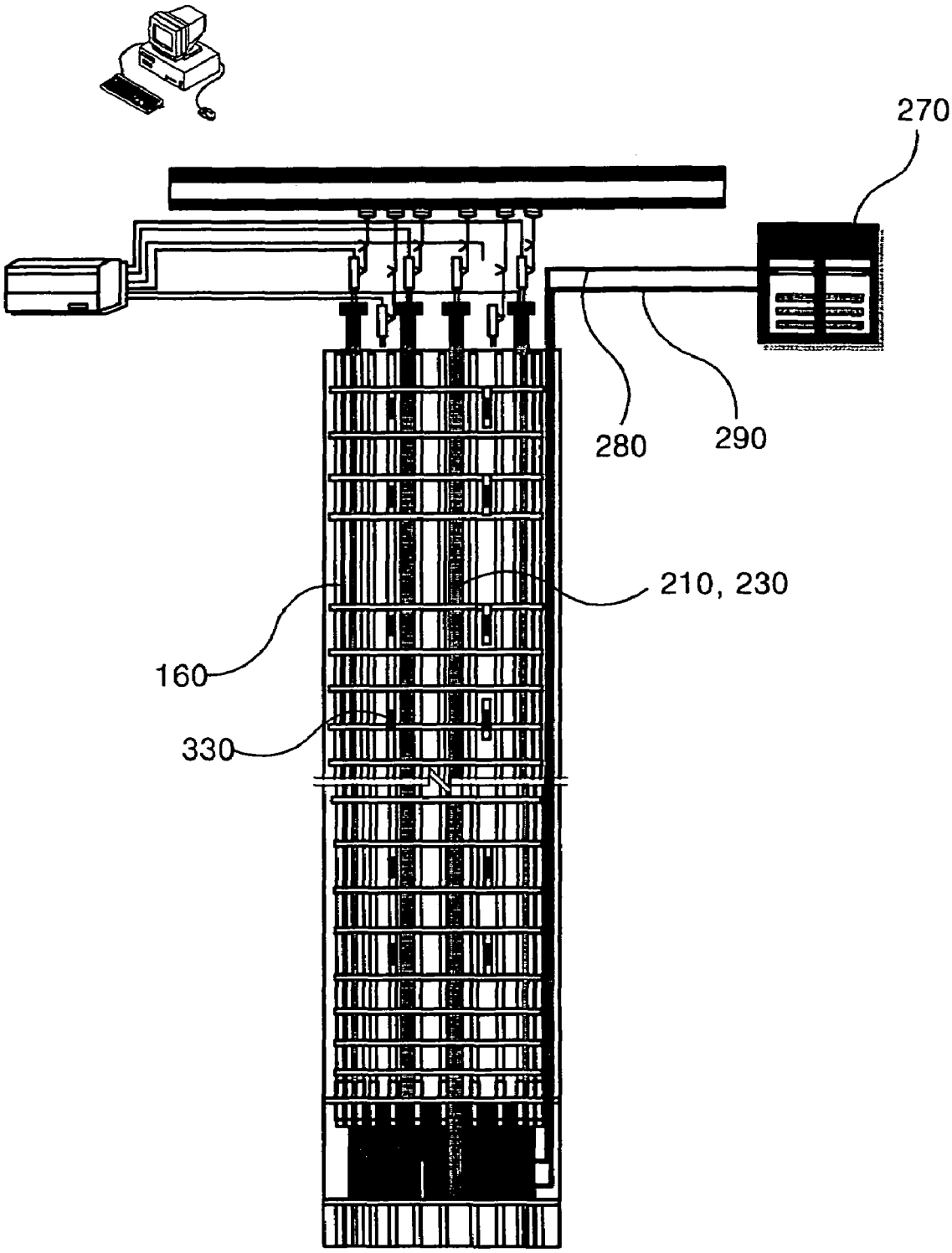
FIG. 9 is a schematic view showing bi-directional pile loading test equipment using a double-action hollowed high-pressure jack according to this invention.
Figure 10:
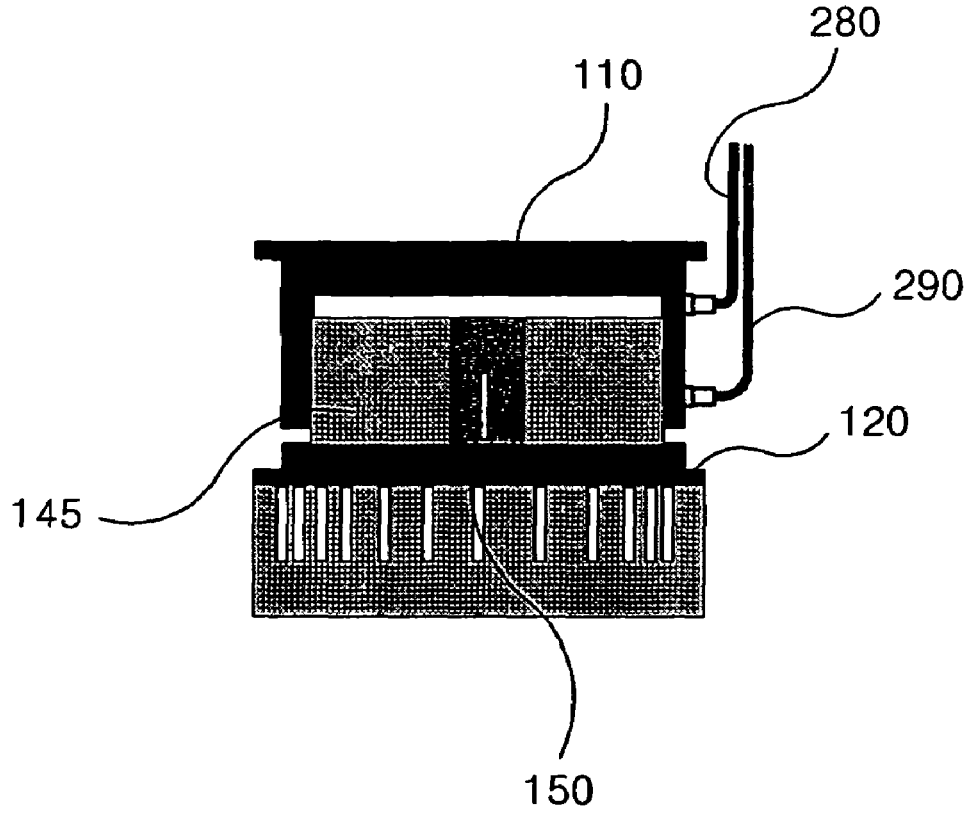
FIG. 10 is a front view of FIG. 9.
Figure 11:
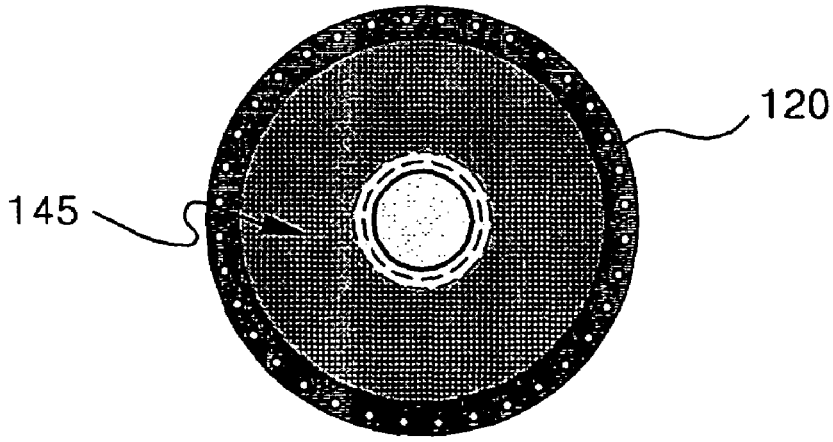
FIG. 11 is a plan view of FIG. 9.
Figure 12:
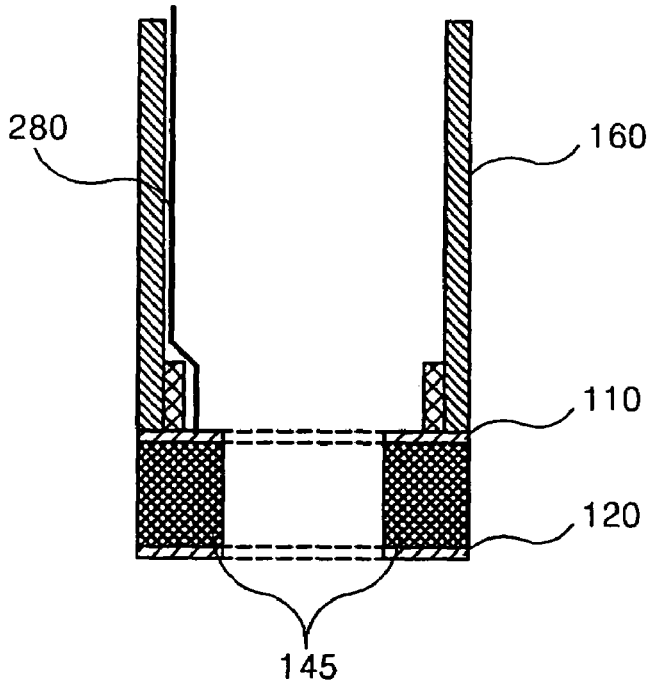
FIG. 12 is a cross-section view showing establishment of a double-action hollowed high-pressure jack at the exterior of the front end of open steel tube piles according to the invention.
Figure 13:
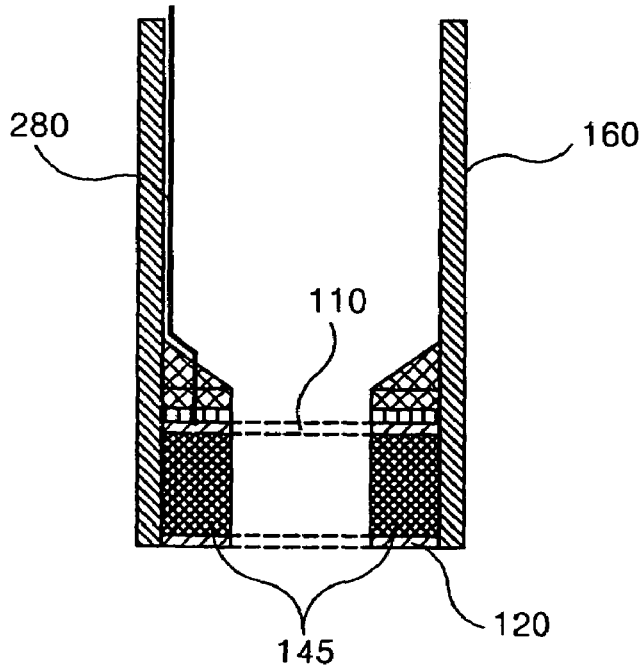
FIG. 13 is a cross-section view showing establishment of a double-action hollowed high-pressure jack at the interior of the front end of open steel tube piles according to this invention.
Figure 14:
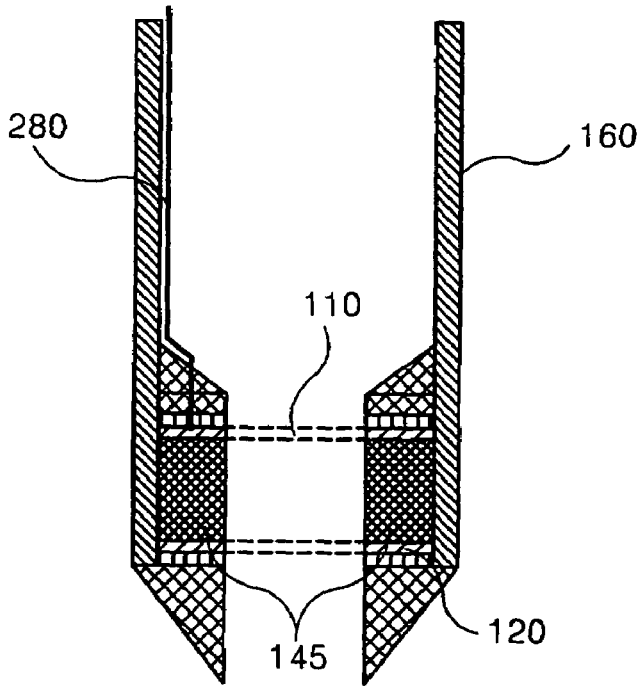
FIG. 14 is a cross-section view showing establishment of a shoe at the front end of open steel tube piles after a double-action hollowed high-pressure jack is installed at the interior of the front end according to this invention.
Figure 15:
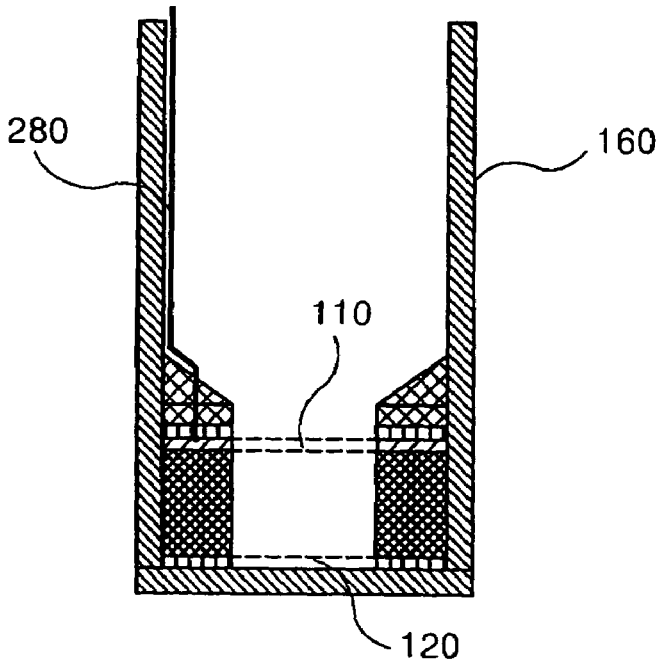
FIG. 15 is a cross-section view showing establishment of a double-action hollowed high-pressure jack at the exterior of the front end of close steel tube piles according to this invention.
Figure 16:
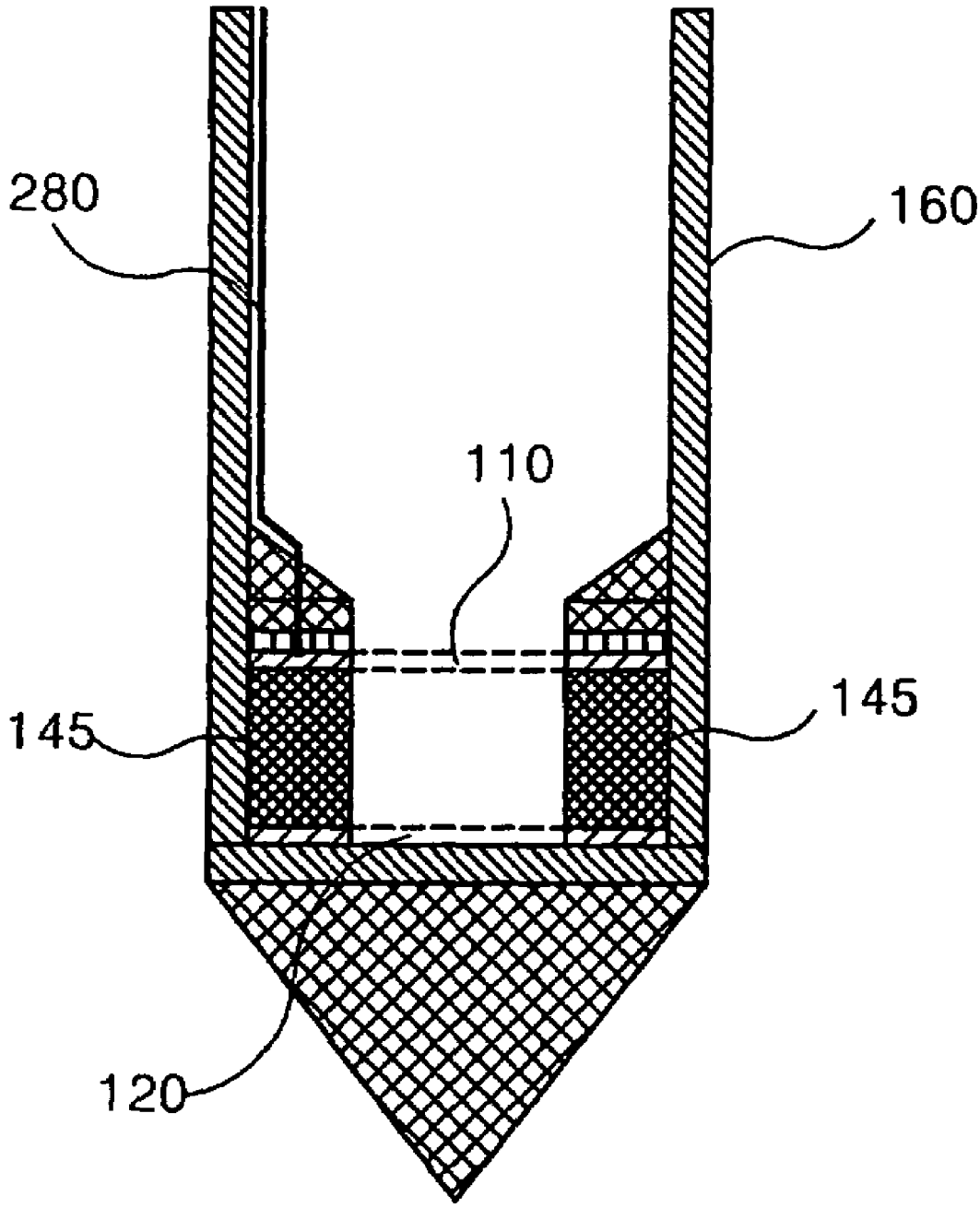
FIG. 16 is a cross-section view showing establishment of a shoe at the front end of close steel tube piles after a double-action hollowed high-pressure jack is installed at the interior of the front end according to this invention.

FIG. 9 is a schematic view showing bi-directional pile loading test equipment using a double-action hollowed high-pressure jack according to this invention, FIG. 10 is a front view of FIG. 9, FIG. 11 is a plan view of FIG. 9, FIG. 12 is a cross-section view showing establishment of a double-action hollowed high-pressure jack at the exterior of the front end of open steel tube piles according to this invention, FIG. 13 is a cross-section view showing establishment of a double-action hollowed high-pressure jack at the interior of the front end of open steel tube piles according to this invention, FIG. 14 is a cross-section view showing establishment of a shoe at the front end of open steel tube piles after a double-action hollowed high-pressure jack is installed at the interior of the front end according to this invention, FIG. 15 is a cross-section view showing establishment of a double-action hollowed high-pressure jack at the exterior of the front end of closed steel tube piles according to this invention, and FIG. 16 is a cross-section view showing establishment of a shoe at the front end of close steel tube piles after a double-action hollowed high-pressure jack is installed at the interior of the front end according to this invention.

As shown in these drawings, bi-directional piles loading test equipment using a double-action hollowed high-pressure jack according to this invention comprises: an upper disc 110 having a predetermined thickness and diameter; a lower disc 120 positioned at the upper disc 110; a double-action hollowed high-pressure jack 145 positioned between the upper disc 110 and the lower disc 120; an upper displacement measuring rod 210 vertically installed on an upper surface of the upper disc 110 for measuring a displacement of the upper disc 110: a lower displacement measuring rod 230 vertically installed on an upper surface of the lower disc 120 for measuring a displacement of the lower disc 120; an oil cylinder inflation displacement measuring sensor 150 coupled to a side of the double-action hollowed high-pressure jack 145; an oil pump 270 supplying an oil pressure to the double-action hollowed high-pressure jack 145; a high oil pressure hose 280; a load and pressure adjustor supplying an oil pressure produced by the oil pump 270; and a stroke restoring oil hose 290 for conveying the second pressurized oil supplied by the oil pump 210 to the double-action high pressure jack 145 in order to restore the first pressurized oil in the double-action high pressure jack 145 to the oil pump 270 after completion of the ferroconcrete piles loading test, with the result that a stroke of the double-action high pressure jack 145 projected to an exterior is restored to its original state.

The, advantages of the double-action hollowed high-pressure jack 145 are as follows.

First, it overcomes a limit of loading capacity by making the loading square area wider.

For example, by employing an oil pressure jack having a predetermined pressure of 1500 kgf/cm$^2$ in the case of using piles 160 having a diameter of 2,000 mm, it is possible to obtain a loading capacity of about 6,000 tonf with six oil pressure jacks, but it is possible to obtain a loading capacity of about 9,000 tonf with the double-action hollowed high-pressure jack 145 alone if the double-action hollowed high-pressure jack 145 is employed.

Furthermore, it is economical to manufacture the piles loading test equipment because only one double-action hollowed high-pressure jack 145 is employed.

In addition, an eccentricity in loading a load is prevented when one double-action hollowed high-pressure jack 145 is installed at the center of the piles 160, and it is easy to control the load, thereby achieving test safety.

Also, the hollow of the double-action hollowed high-pressure jack 145 becomes enlarged, making it easier to pour a ready mixed concrete, which is a working convenience.

Piles incapable of being handled by bi-directional piles loading test equipment (that is, medium and small diameter piles installed at a scene, loading closed piles, buried piles, and so on) can be handled by the bi-directional piles loading test equipment, and it is also possible to handle loading closed steel tube piles.

EXAMPLE 2

Figure 17:
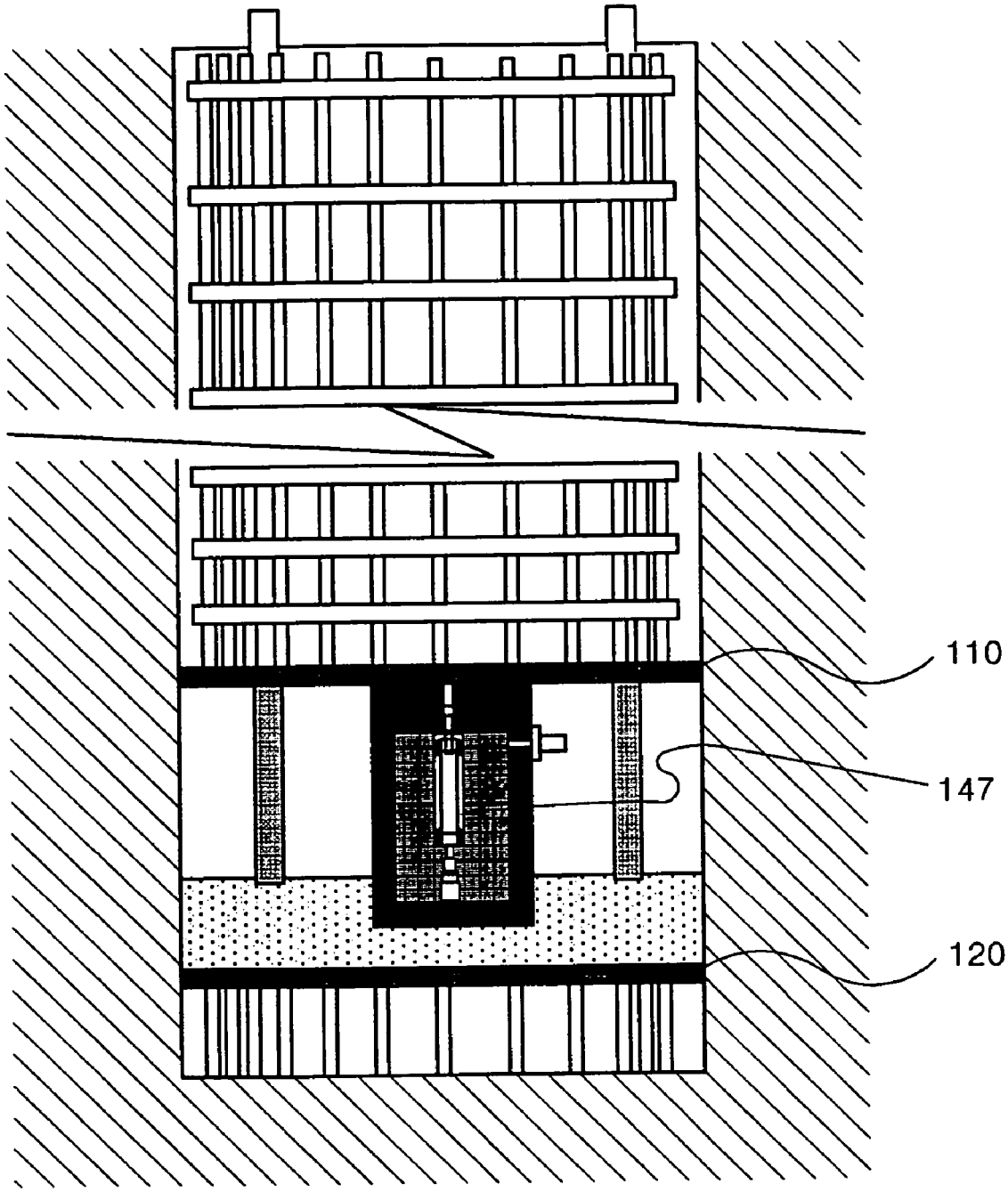
FIG. 17 is a schematic view showing bi-directional test equipment using a spring restoration type single-action oil pressure jack according to this invention.
Figure 18:
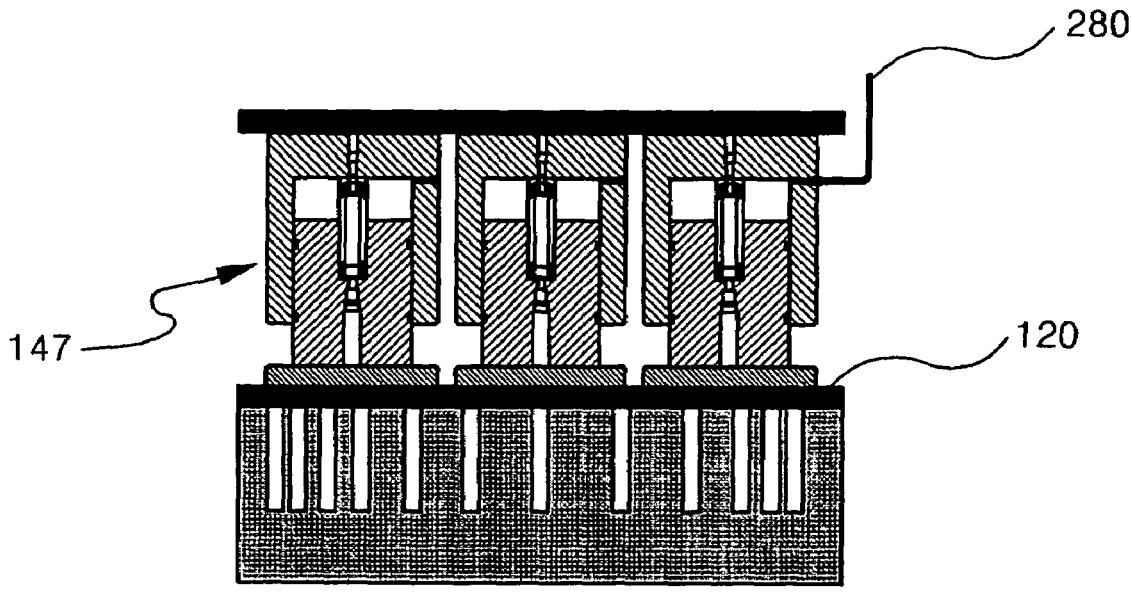
FIG. 18 is a front view showing a spring restoration type single-action oil pressure jack according to this invention.
Figure 19:
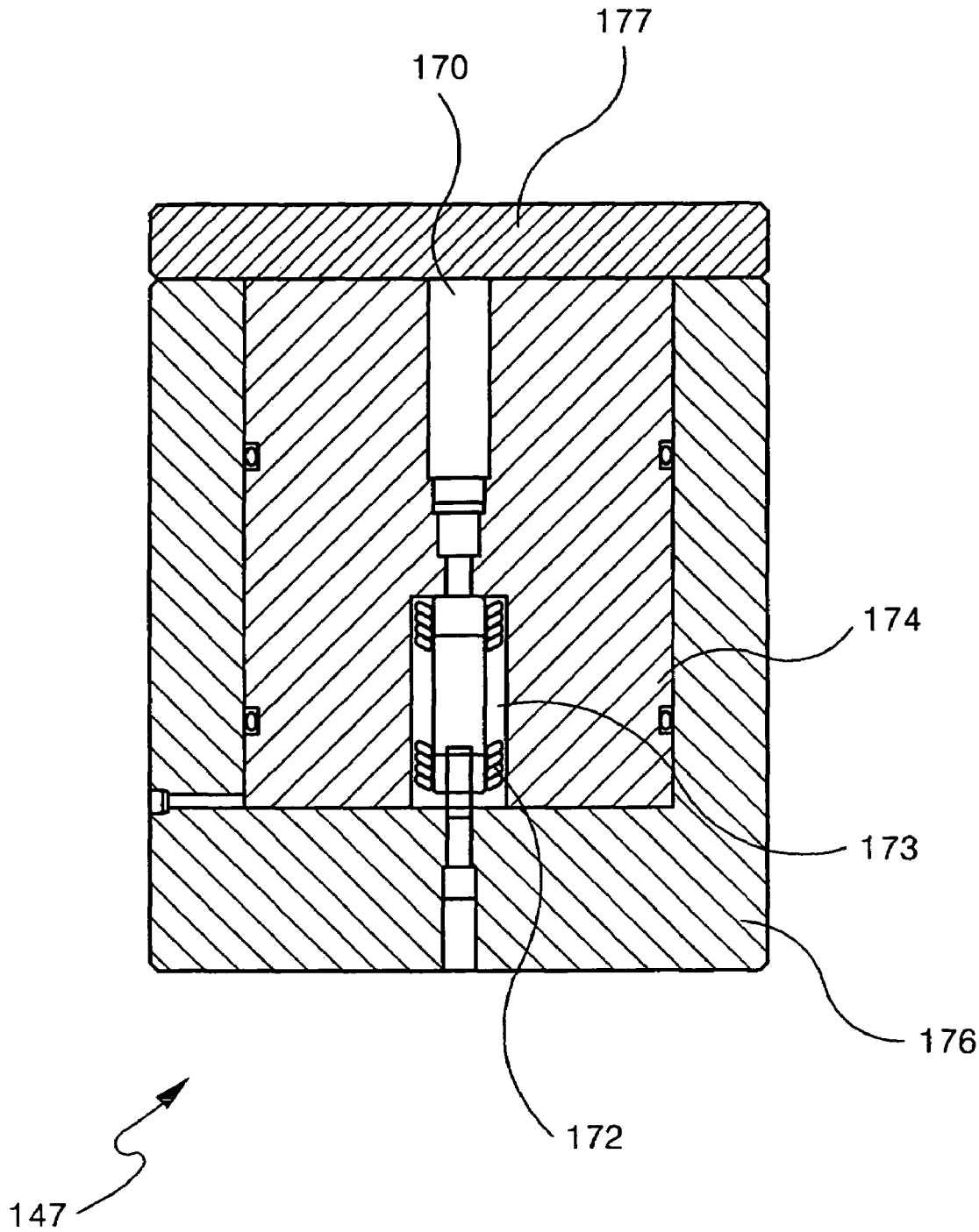
FIG. 19 is a cross-section view showing the internal structure of a spring restoration type single-action oil pressure jack according to this invention.
Figure 20A:
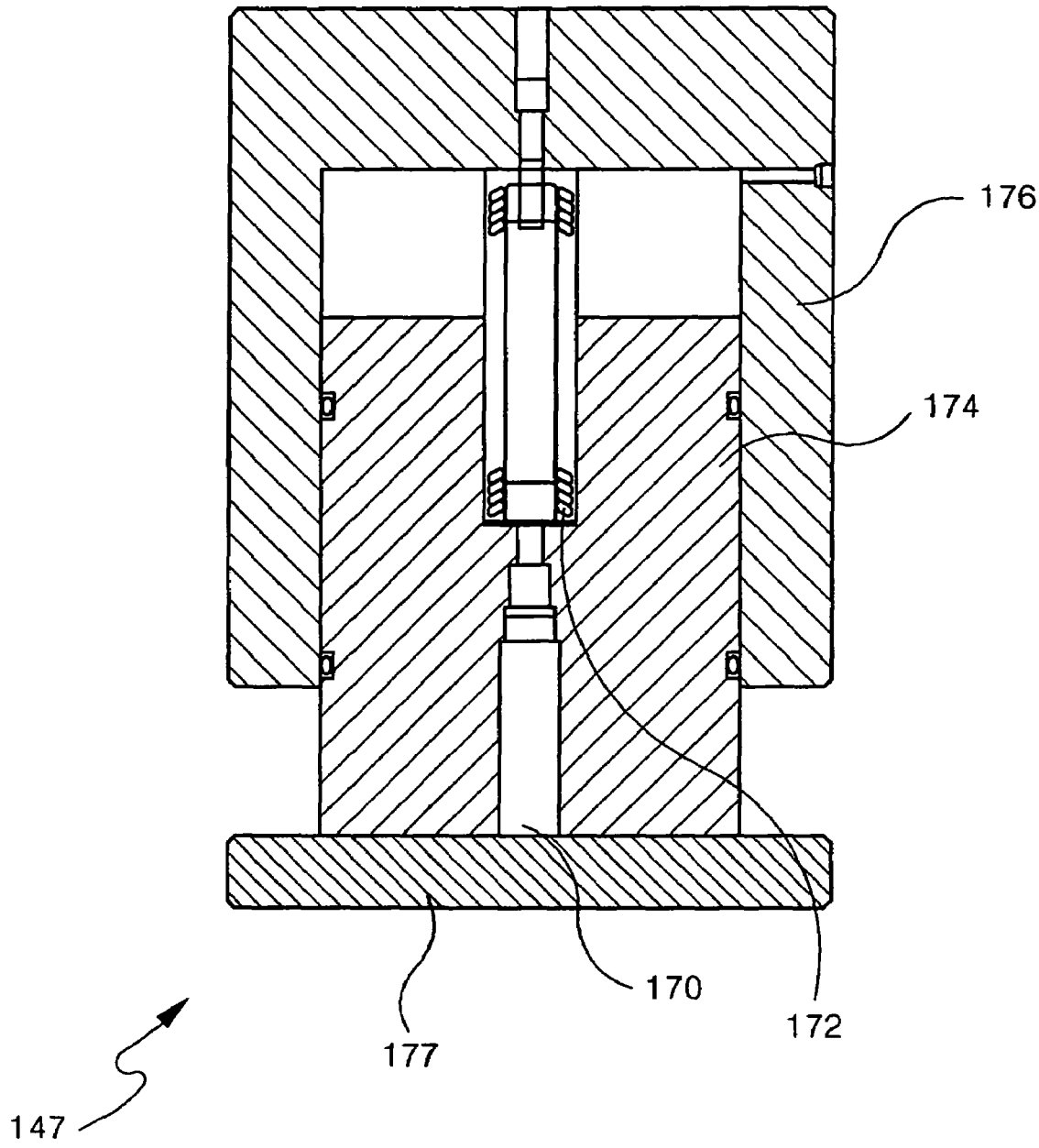
FIG. 20A and FIG. 20B are exemplary views showing a state in which a stroke of the pressure jack after completion of a bi-directional pile loading test is restored by means of a spring elastic force installed on its interior according to this invention.
Figure 20B:
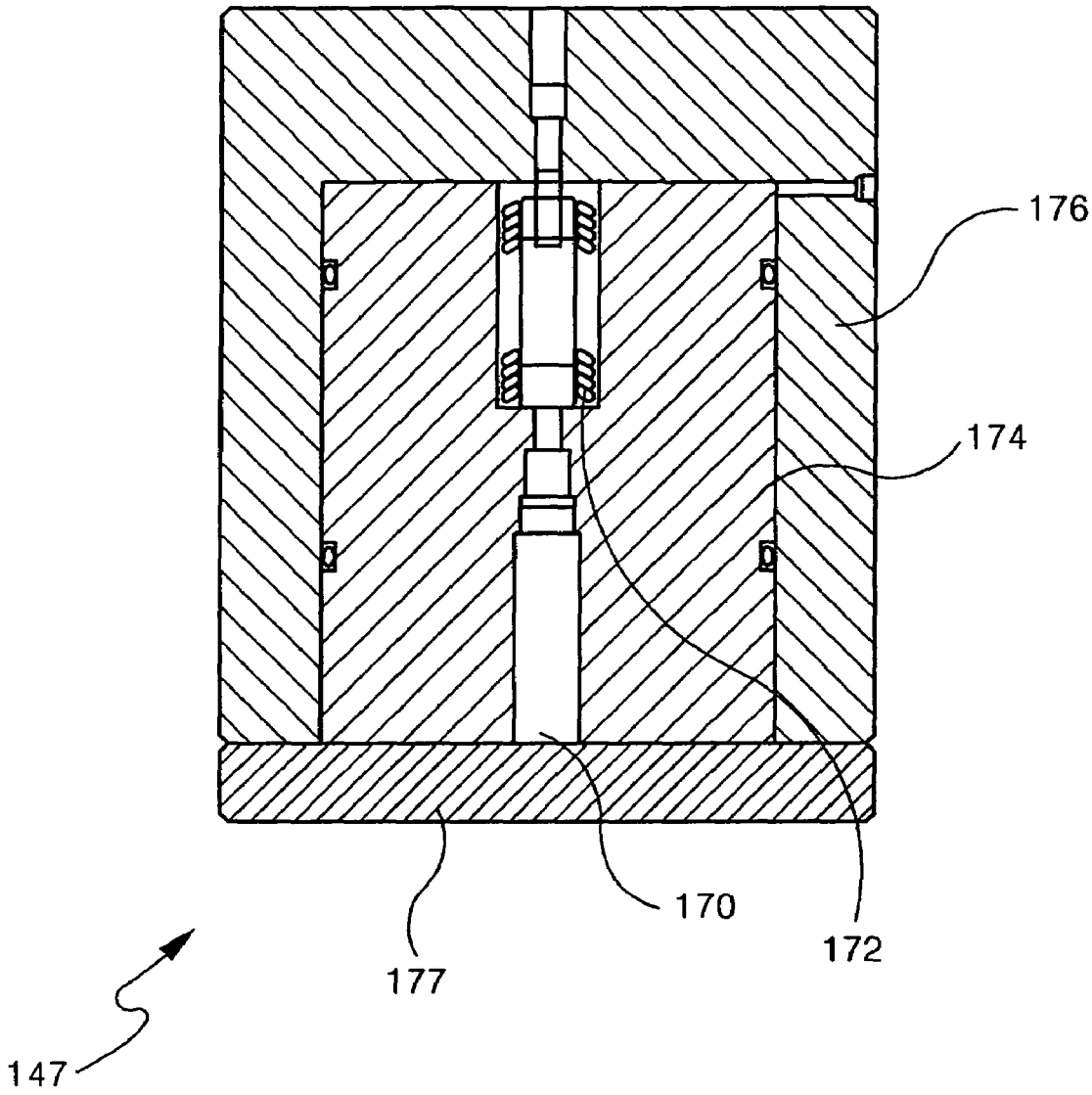

FIG. 17 is a schematic view showing bi-directional test equipment using a spring restoration type single-action oil pressure jack according to this invention, FIG. 18 is a front view showing a spring restoration type single-action oil pressure jack according to this invention, FIG. 19 is a cross-section view showing the internal structure of a spring restoration type single-action oil pressure jack according to this invention, and FIG. 20A and FIG. 20B are exemplary views showing a state in which a stroke of the oil pressure jack after completion of a bi-directional piles loading test is restored by means of a spring elastic force installed on its interior according to this invention.

As shown in these drawings, bi-directional piles loading test equipment using a spring restoration type single-action oil pressure jack according to this invention comprises: an upper disc 110 having a predetermined thickness and diameter; a lower disc 120 positioned below the upper disc 110; a spring restoration type single-action oil pressure jack 147 positioned between the upper disc 110 and the lower disc 120; an upper displacement measuring rod 210 vertically installed on an upper surface of the upper disc 110 for measuring a displacement of the upper disc 110: a lower displacement measuring rod 230 vertically installed on an upper surface of the lower disc 120 for measuring a displacement of the lower disc 120; an oil pressure jack displacement instrument 260 coupled to the side of the spring restoration type single-action oil pressure jack 147; an oil pump 270 supplying oil pressure to the spring restoration type single-action oil pressure jack 147; a high oil pressure hose 280; and a load and pressure adjustor (not shown) supplying oil pressure produced by the oil pump 270.

The spring restoration type single-action oil pressure jack 147 includes a spring connection rod 170 installed at the center, a spring 172 coupled to the outer circumstance faces of the spring connection rod 170, a spring system 173 covered by outer circumstantial faces thereof, a piston rod 174 coupled to the upper part of the spring connection rod 170, a tube 176 enclosing an outer portion of the piston rod 174, and a cylindrical upper disc 177 coupled to an upper part of the piston rod 174.

Operation of the above described bi-directional piles loading test equipment using a spring restoration type single-action oil pressure jack according to this invention will be explained.

After the spring restoration type single-action oil pressure jack is established in the bi-directional piles loading test equipment so that a desired loading capacity may be obtained, first, the high oil pressure hose 280 coupled to a distributing device installed on the oil pressure pump 270 to individually adjust a plurality of spring restoration type single-action oil pressure jacks is installed in correspondence to the number of spring restoration type single-action oil pressure jacks 147. Then, a predetermined pressure is applied to the spring restoration type single-action oil pressure jacks 147 by the operation of the oil pressure pump 270, and at the same time, a predetermined pressure is adjusted to a number to be displayed on a display device of the load and pressure adjustor, resulting in carrying out a bi-directional pile loading test by measuring a displacement of the piles using the upper and lower displacement measuring rods 210 and 230, respectively.

Continuously, a stroke of the spring connection rod 170 projected to the exterior by the restoration force of the spring 172 installed inside the spring restoration type single-action oil pressure jack 147 after completion of the piles loading test equipment is restored, thereby preventing formation of remaining space at the interior of the spring connection rod 170.

EXAMPLE 3

FIG. 8 A is a graph showing an abrasion distribution chart at a column face with every step of a measured load in the case that a loading apparatus 100 is installed at the front end of piles, FIG. 8 B is a graph showing a front end load, FIG. 8 C is a graph showing an abrasion distribution chart at a column face with every step of a measured load changed in the case of head loading, and FIG. 8 D is a graph showing an axis load distribution chart.

Hereinafter, a method for writing the axis load distribution chart when a loading apparatus 100 is installed at the front end of piles will be explained.

The method for writing the axis load distribution chart comprises a first step of measuring values from an axis load measuring sensor with every loading step.

A second step calculates a piles column face abrasion at a predetermined loading step using the measured values, writes a distribution chart according to its depth.

At this point, a column face abrasion must be calculated considering the load of piles.

A third step then converts the data into an axis load transition distribution chart in the case of loading a piles head so as to prepare an axis load distribution chart.

Continuously, a fourth step determines a front end supporting force corresponding to a downward displacement which is the same as a measured upward displacement at a predetermined loading step.

In addition, in a fifth step, the axis load distribution chart at a predetermined loading step is drawn by the addition of the front end supporting force, determined in the fourth step, to the piles column face abrasion, calculated in the second step.

A fifth step is repeatedly carried out from the first step to the fifth step to complete the writing of the axis load distribution chart with regard to a representative loading step.

Figure 21A:
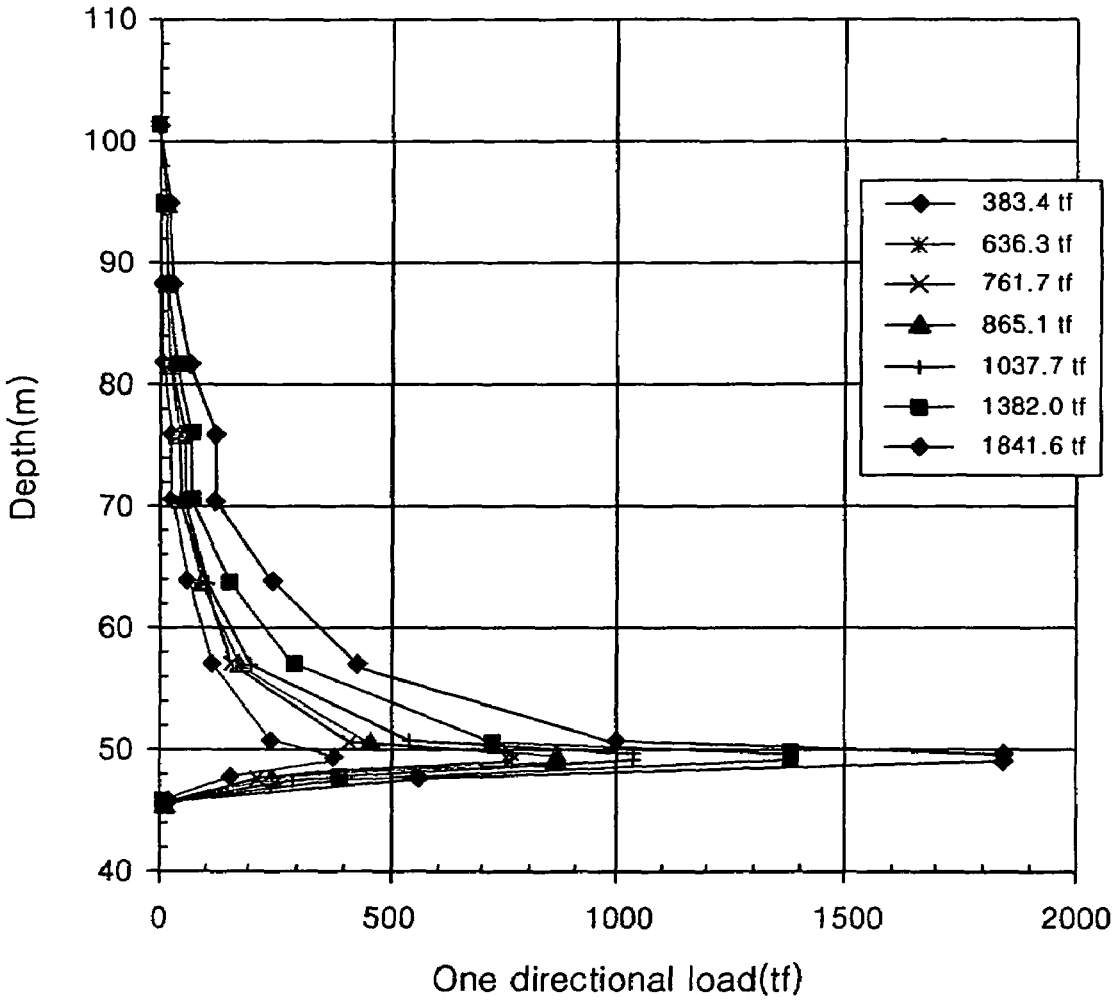
Figure 21B:
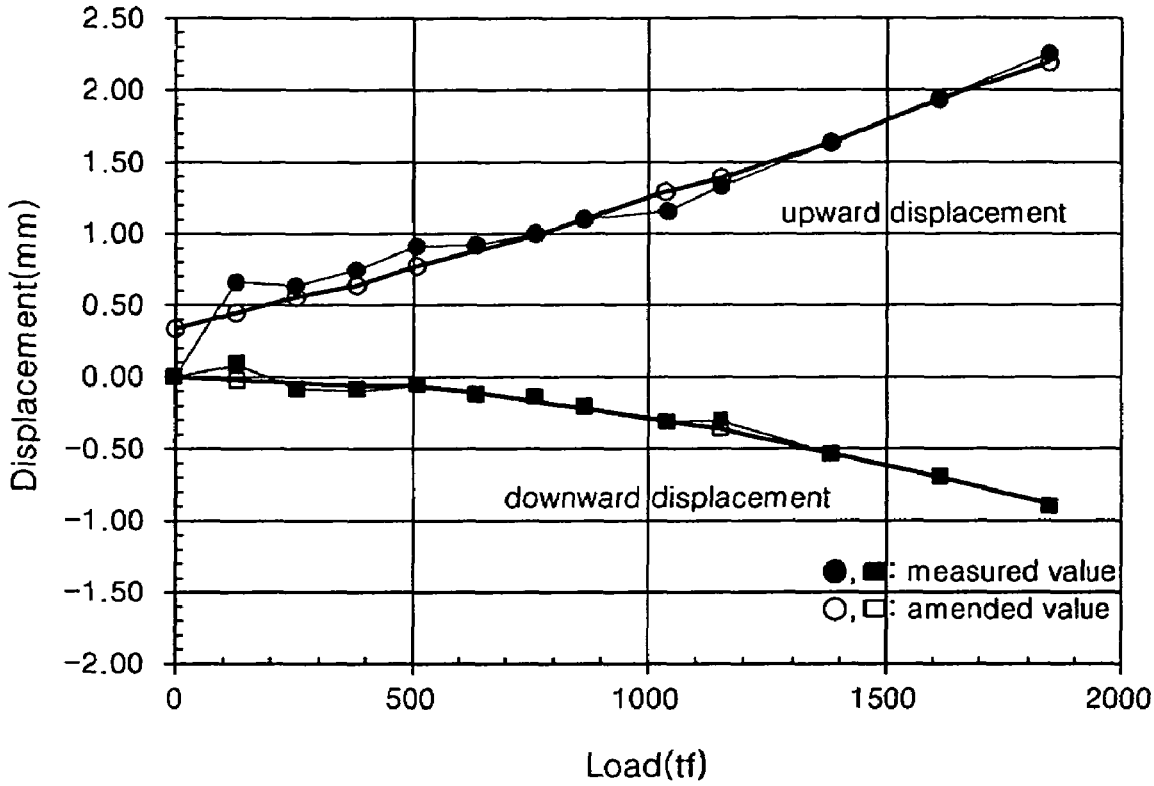
Figure 21C:
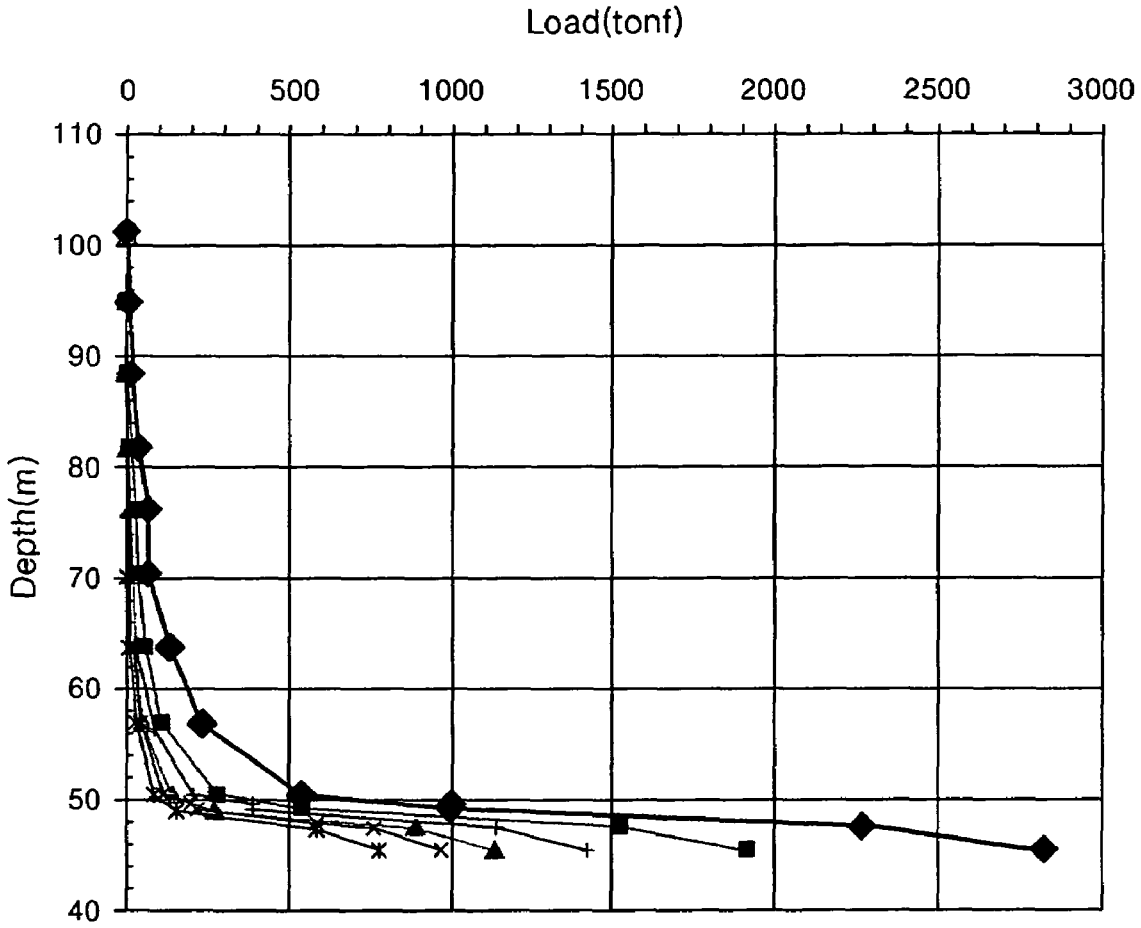
Figure 21D:
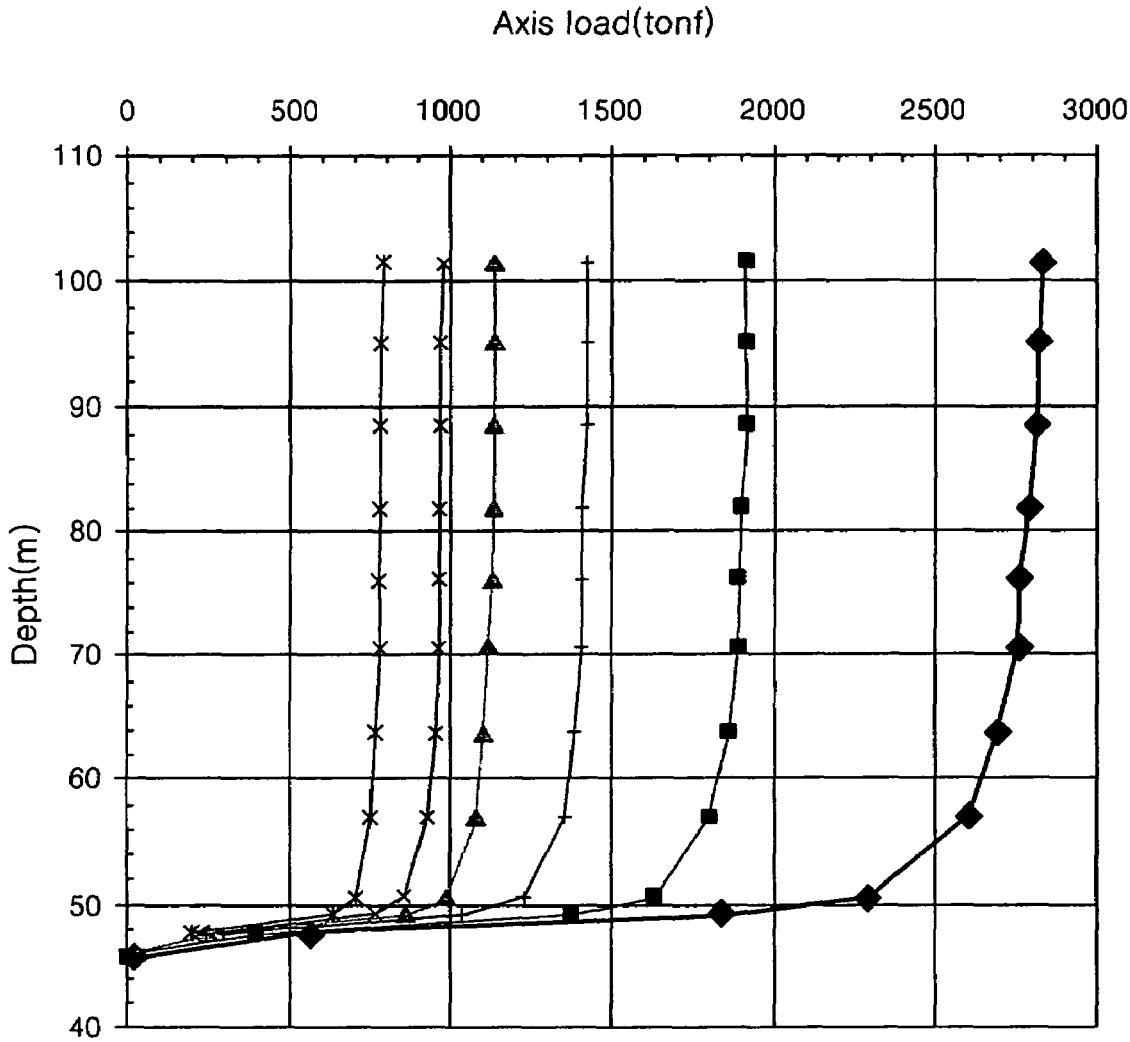

FIG. 21A to FIG. 21D represent writing methods relating to axis load distribution for use when double-action hollowed bi-directional testing equipment using a high-pressure jack is established between piles, wherein FIG. 21A is a graph showing column face abrasion, FIG. 21B a graph showing upward/downward displacement-one direction load, FIG. 21C is a graph showing abrasion distribution, and FIG. 21D is a graph showing axis load distribution The writing of the axis load distribution chart comprises: a first step of measuring values of the axis load sensor 330 coupled at upper and the lower portions of the upper and lower discs 110 and 120, respectively, for every loading step; a second step of calculating a piles column face abrasion at a predetermined loading step using the measured values from the axis load sensor 330 in the first step, and writing a distribution chart according to its depth; a third step of calculating the size of an abrasion with respect to the same upward load as a sinking amount at a predetermined downward loading step from the written distribution chart in the second step, and successively calculating a total abrasion distribution chart by directionally converting the abrasion distributions at the lower portion of the upper and lower discs 110 and 120, respectively, after the abrasion distribution on the lower of the upper and lower discs 110 and 120, respectively, with respect to the downward load is combined with the abrasion distribution on the upper of the upper and lower discs 110 and 120, respectively, with respect to the upward load; a fourth step of writing the axis load distribution chart at a predetermined loading step by the addition of the component of the front end supporting force of a piles front end in the second step; and a fifth step of repeatedly carrying out the first step thru the fourth step, and completing the writing of the axis load distribution chart with regard to a representative loading step.

Also, a preferred procedure for writing the axis load distribution chart when the piles loading test equipment is installed at the center of the piles will be explained hereinafter, referring to FIG. 21A to FIG. 21D.

The preferred procedure for writing the axis load distribution chart comprises: a first process of measuring values of the axis load sensor 330 coupled at the upper and the lower ends of the upper and lower discs 110 and 120, respectively, for every loading step, and a second process of calculating a piles column face abrasion at a predetermined loading step using the measured values from the axis load sensor 330 in the first step, and writing a distribution chart according to its depth as shown in FIG. 21A.

At this point, a column face abrasion corresponding to a height of the double-action hollowed high-pressure jack 145 is not taken into consideration.

The size of an abrasion with respect to the same upward load as a sinking amount at a predetermined downward loading step from FIG. 9, written at the second process, is calculated by a third process as shown in FIG. 21B. At the same time, the abrasion distributions on the lower of the upper and lower discs 110 and 120, respectively, is directionally converted after the abrasion distribution on the lower of the upper and lower discs 110 and 120, respectively, with respect to the downward load is combined with the abrasion distribution at the upper of the upper and lower discs 110 and 120, respectively, with respect to the upward load.

For example, if the abrasion distribution when the upward abrasion corresponding to an upward displacement of 5.2 mm is 537.8 tonf, and the abrasion distribution when the downward abrasion corresponding to the downward displacement of 5.2 mm is 1382 tonf, are directionally converted and combined, a total abrasion distribution is calculated as shown in FIG. 21C.

The preferred procedure for writing the axis load distribution chart further includes: a fourth process of writing the axis load distribution chart at a predetermined loading step by the addition of the component of the front end supporting force of a piles front end in the second process after being directionally converted in third process, and a fifth process of repeatedly carrying out the first process to the fourth process, and completing the writing of the axis load distribution chart with regard to a representative loading step as shown in FIG. 21D.

Here, the maximum range of a useful load is the sum of the upper and lower loads corresponding to a small one of the upper and lower displacements, wherein all of the upper and lower displacements and their sum are actual measured values.

EXAMPLE 4

Figure 22:
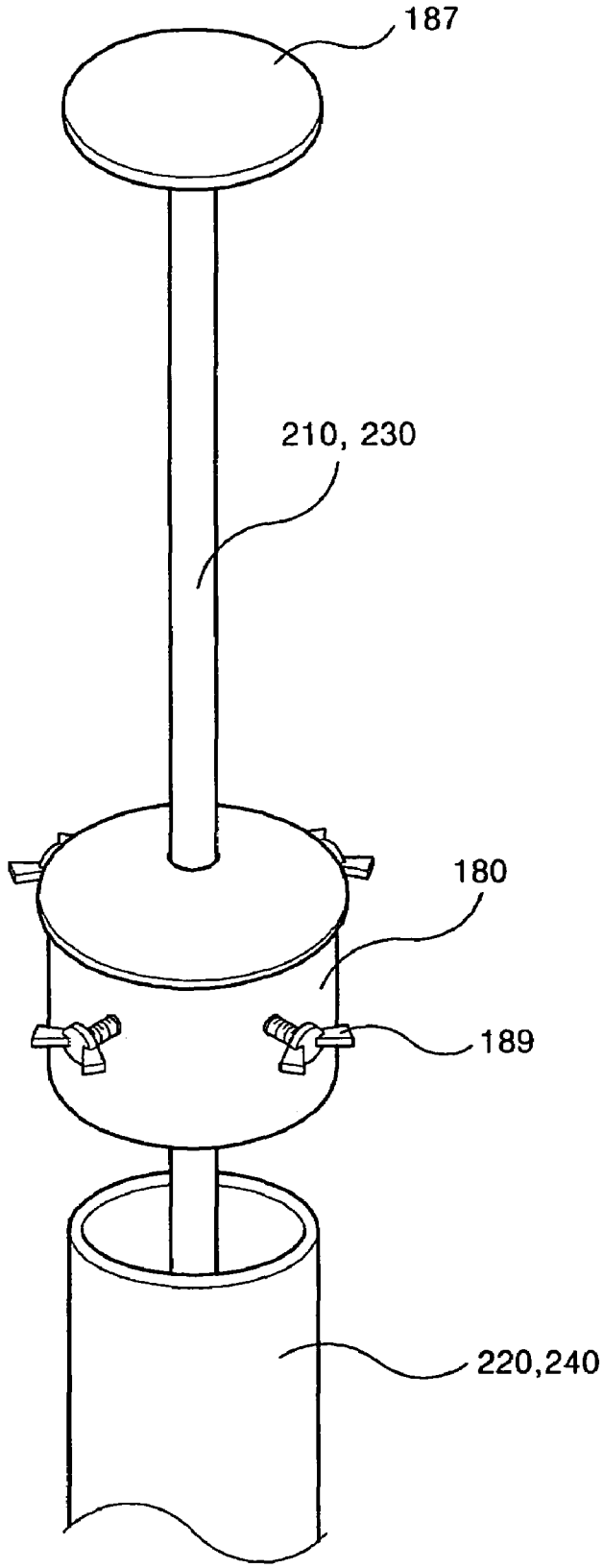
FIG. 22 is a perspective view showing a displacement measuring rod of a bi-directional pile loading test equipment according to this invention.
Figure 23:
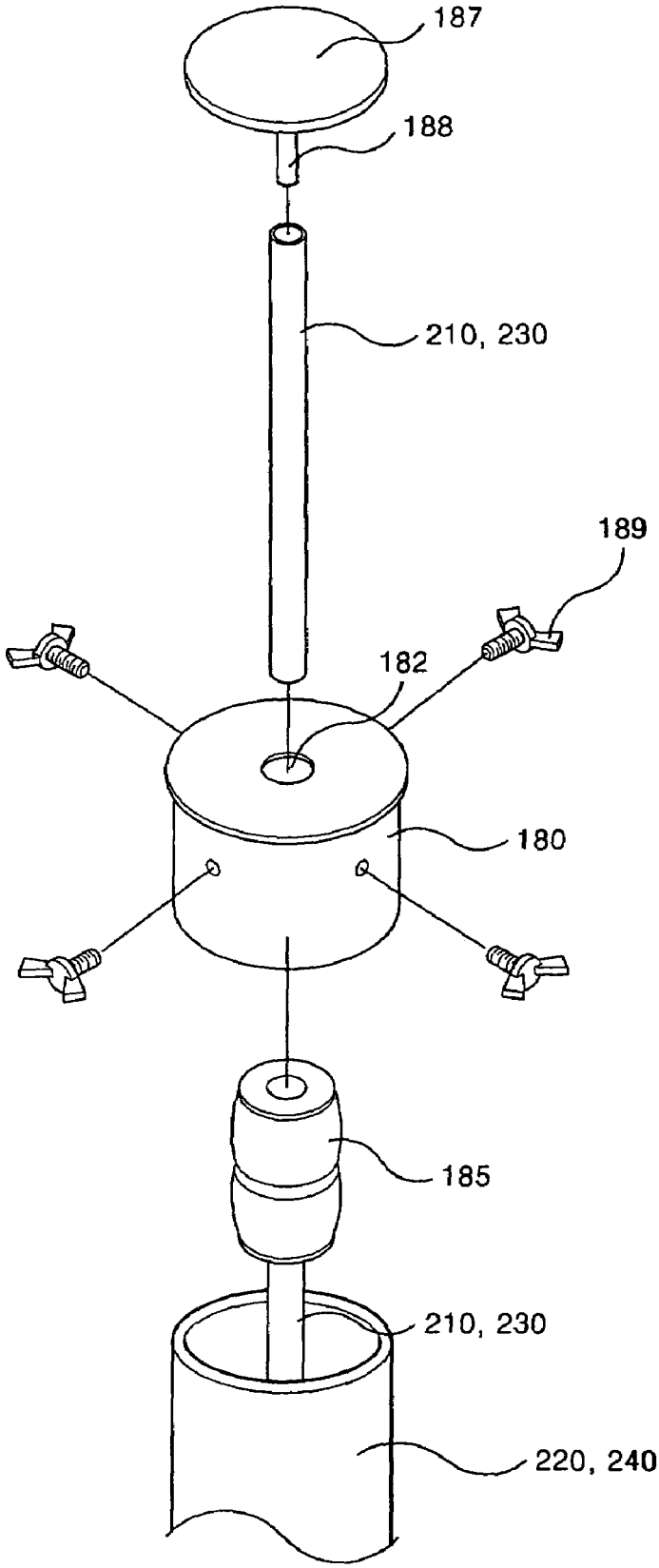
FIG. 23 is a perspective view showing a separate state of a displacement measuring rod of bi-directional pile loading test equipment according to this invention.
Figure 24:
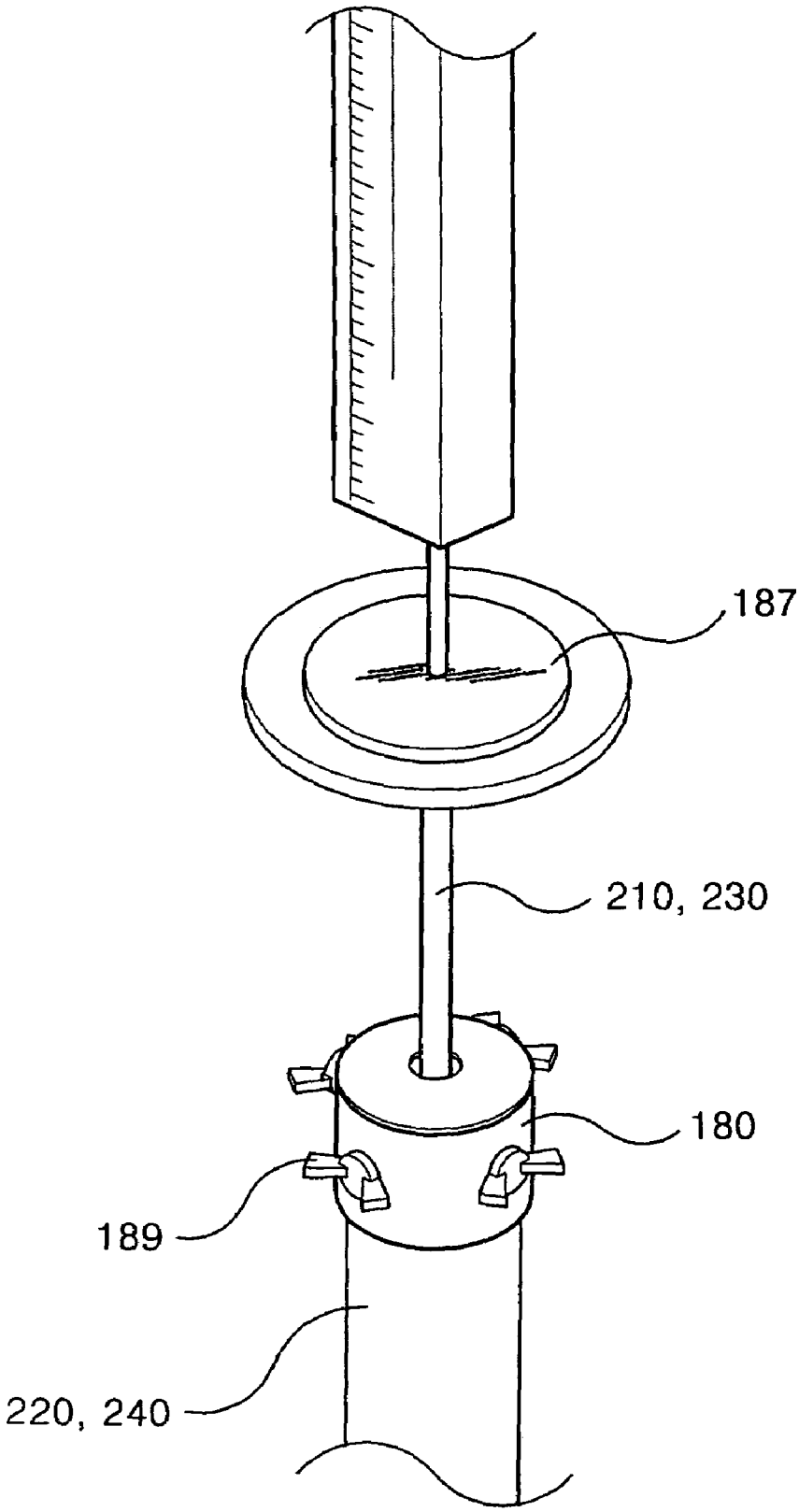
FIG. 24 is an exemplary view showing establishment of a displacement measuring rod of bi-directional pile loading test equipment to a casing according to this invention.

FIG. 22 is a perspective view showing a displacement measuring rod of a bi-directional pile loading test equipment according to this invention, FIG. 23 is a perspective view showing a separate state of a displacement measuring rod of bi-directional pile loading test equipment according to this invention, and FIG. 24 is an exemplary view showing establishment of a displacement measuring rod of bi-directional pile loading test equipment to a measuring rod casing according to this invention.

As shown in these drawings, the displacement measuring rod of the bi-directional pile loading test equipment according to this invention comprises: a perpendicular induction cover 180 having a penetration hole 182 at its center for insertion into a predetermined part of the upper and lower displacement measuring rod casings 220 and 240, respectively, and formed in a cylindrical shape; upper and lower displacement measuring rods 210 and 230, respectively, having a predetermined length for insertion into the penetration hole 182 of the induction cover 180, and formed in a hollowed rod shape; a connection member 185 for insertion into the interior of the induction cover 180, and for adherence by one touch for coupling to the upper and lower displacement measuring rods 210 and 230, respectively; and a supporting plate 187 for positioning at the top of the induction cover 180, and for having an insertion rod 188 at its one side so that the insertion rod 188 may prevent the top end of the upper and lower displacement measuring rods 210 and 230, respectively, from cont action the exterior.

Here, plural nuts 189 are formed on the outer surface of the induction cover 180 to fixedly support the upper and lower displacement measuring rods 210 and 230, respectively, at a predetermined position.

Operation of the displacement measuring rod of the bi-directional pile loading test equipment according to this invention will be explained hereinafter.

After completion of an assembly of each component in the displacement measuring rod, the induction cover 180 is inserted in the upper and lower displacement measuring rod casings 220 and 240, respectively, thereby completing installation of the displacement measuring rod.

In this regard, it is well known that the upper and lower displacement measuring rods 210 and 230, respectively, are not moved left or right due to the insertion of the induction cover 180 in the upper and lower displacement measuring rod casings 220 and 240, respectively, and therefore a measured value is not varied.

In addition, when the upper and lower displacement measuring rods 210 and 230, respectively, having a predetermined length are extended as occasion demands, it is adopted in the one-touch manner so that the upper and lower displacement measuring rods 210 and 230, respectively, are simply inserted into the connection member 185. As a result, adherence or lack of adherence is easily achieved at each component in the displacement measuring rod.

With the apparatus and method for measuring a supporting force of large diameter ferroconcrete piles installed at a scene by means of a bi-directional front end oil pressure loading apparatus using a high pressure loading system of this invention, the invention is able to overcome a limit on loading capacity due to an efficient arrangement of an oil pressure cylinder with regard to a predetermined surface of substrate piles, and to reduce the manufacturing cost of the test equipment by decreasing the number of oil pressure cylinders.

Furthermore, the invention is able to decrease the number of piles by doubling a tolerant supporting force of piles while obtaining a high pile supporting capacity, and to have a high degree of safety and reliability in loading by decreasing the number of oil pressure hoses because the number of oil pressure cylinders is decreased when an oil pressure cylinder is employed.

Furthermore, the invention is able to achieve a high loading capacity and a low manufacturing cost, and to obtain working convenience by adjusting a hollow diameter, and one is able to apply the invention to medium and small diameter piles installed at the scene, loading closed piles, and buried piles, in addition to large diameter piles.

Especially, the invention is able to freely change a hollow diameter, and one is able to obtain an insertion space of a tremie tube with the remainder after an oil jack is arranged for a desired loading capacity in the case of a general bi-directional loading test because the diameter of the tremie tube for receiving poured ready mixed concrete at working piles installed at the scene is different for every operational condition.

More specifically, the invention is able to obtain prolonged safety of substrate piles by removing an internal remainder space, and by efficiently arranging an oil jack about a predetermined surface size because of a small surface for the purpose of obtaining a desired capacity.

In addition, the invention is economic as to manufacturing cost, which results from having a simple manufacturing procedure and internal structure, as well as not establishing an oil pressure hoses for restoring the stroke of an oil pressure jack projected to the exterior, and having a high degree of reliability.

Moreover, it takes a short time to carry out a test due to the omission of a restoration process in a cylinder action procedure with the automatic restoration of a stroke in a cylinder by an elastic force of a spring installed at the interior of a cylinder projected to the exterior.

Finally, the invention is able to reduce weight because of its being made of stainless materials, and to easily adhere each component in the displacement measuring rod to a connection member in a one-touched manner or not.

Although preferred embodiments of the present invention have been described in detail, it will be appreciated by those skilled in the art to which the present invention pertains that several modifications and variations can be made without departing from the spirit and scope of the present invention as defined in the appended claims. Accordingly, future variations of the embodiments of the present invention can be covered by the technique of the present invention.

What is claimed is:

1. An apparatus for measuring a supporting force of ferroconcrete piles installed at a scene by means of a bi-directional front end oil pressure loading apparatus using a high pressure loading system, comprising:

a loading apparatus including a steel plate having a predetermined thickness and diameter, upper and lower discs having penetration holes formed therein for passing a fixing member for separating the upper and lower discs by a predetermined distance, an oil pressure cylinder for producing an oil pressure force, and a sensor installed adjacent to the oil pressure cylinder for measuring a displacement;

a displacement measuring arrangement including an upper displacement measuring rod coupled to the upper disc for measuring a displacement of the upper disc, and a lower displacement measuring rod coupled to the upper disc for measuring a displacement of the lower disc; and a load transition measuring instrument including a tremie induction tube coupled to the upper disc for guiding concrete to the penetration holes, iron elements coupled to the upper disc, an axis load sensor coupled to the iron elements for measuring ground abrasion, a sensor line for transferring at least one of a signal and a current to the axis load sensor, and a measuring system for storing and displaying measured data from the axis load sensor.

2. The apparatus of claim 1, wherein said displacement measuring arrangement includes an upper displacement measuring rod casing containing the upper displacement measuring rod and a lower displacement measuring rod casing containing the lower displacement measuring rod.

3. The apparatus of claim 1, wherein said upper and lower displacement measuring rods are connected perpendicularly to the upper and lower discs, respectively.

4. The apparatus of claim 1, wherein said load transition measuring instrument includes a sister bar coupled to the iron elements, said sensor line transferring said at least one of the signal and the current to the sister bar.

5. The apparatus of claim 4, wherein said measuring system stores and displays measured data from the sister bar.

6. The apparatus of claim 1, wherein said load transition measuring instrument includes an extension line connected to said sensor line and having a predetermined length for preventing a disconnection.

7. An apparatus for measuring a supporting force of ferroconcrete piles installed at a scene by means of a bi-directional front end oil pressure loading apparatus using a high pressure loading system, comprising:

an upper disc having a predetermined thickness and diameter;

a lower disc positioned below the upper disc;

a double-action high-pressure jack positioned between the upper disc and the lower disc;

an upper displacement measuring rod vertically installed on an upper surface of the upper disc for measuring a displacement of the upper disc;

a lower displacement measuring rod vertically installed on an upper surface of the lower disc for measuring a displacement of the lower disc;

an oil pressure jack displacement instrument coupled to a side of the double-action high-pressure jack;

an oil pump for sequentially supplying first and second pressurized oil to the double-action high-pressure jack;

an oil pressure hose and a load and pressure adjuster for conveying the first pressurized oil, supplied by the oil pump to the double-action high-pressure jack, for test loading of the ferroconcrete piles; and a stroke restoring oil hose for conveying the second pressurized oil, supplied by the oil pump to the to the double-action high pressure jack, in order to restore the first pressurized oil in the double-action high pressure jack to the oil pump after completion of the testing of the loading of the ferroconcrete piles, whereby a stroke of the double-action high pressure jack projected to an exterior is restored to its original state.

8. The apparatus of claim 7, further comprising a load and pressure adjuster operatively associated with the oil pressure hose for conveying the oil pressure supplied by the oil pump to the double-action high pressure jack.

9. The apparatus of claim 7, wherein the double-action high-pressure jack is hollow.

10. An apparatus for measuring a supporting force of ferroconcrete piles installed at a scene by means of a bi-directional front end oil pressure loading apparatus using a high pressure loading system, comprising:

an upper disc having a predetermined thickness and diameter;

a lower disc positioned below the upper disc;

a spring restoration type signal-action oil pressure jack positioned between the upper disc and the lower disc;

an upper displacement measuring rod vertically installed on an upper surface of the upper disc for measuring a displacement of the upper disc;

a lower displacement measuring rod vertically installed on an upper surface of the lower disc for measuring a displacement of the lower disc;

an oil pressure jack displacement instrument coupled to a side of the spring restoration type signal-action oil pressure jack;

an oil pump for supplying pressurized oil to the spring restoration type signal-action oil pressure jack;

a high oil pressure hose for conveying the pressurized oil supplied by the oil pump to the spring restoration type signal-action oil pressure jacks;

wherein the spring restoration type single-action oil pressure jack comprises:

a spring connection rod installed at a center;

a spring coupled to outer faces of the spring connection rod for applying a restoring force to an inside of the spring restoration type single-action oil pressure jack to return the pressurized oil, supplied to the spring restoration type single-action oil pressure jack, to the oil pump after completion of a piles loading test, whereby a stroke of the spring restoration type single-action oil pressure jack projected to an exterior is restored to its original state;

a spring system covered by the outer faces of the spring connection rod;

a piston rod coupled to the upper part of the spring connection rod; and a tub enclosing an outer portion of the piston rod, and a cylindrical upper disc coupled to an upper part of the piston rod.

11. The apparatus of claim 10, further comprising a load and pressure adjuster operatively associated with the oil pressure hose for conveying the oil pressure supplied by the oil pump to the spring restoration type single-action oil pressure jack.

12. An apparatus for measuring a supporting force of ferroconcrete piles installed at a scene by means of a bi-directional front end oil pressure loading apparatus using a high pressure loading system, comprising:

upper and lower displacement measuring rod casings;

an induction cover having a penetration hole formed therein, said induction cover being insertable into said upper and lower displacement measuring rod casings;

upper and lower displacement measuring rods having a predetermined length and insertable into the penetration hole of the induction cover;

a connection member insertable into an interior of the induction cover and having a penetration hole formed therein for use in coupling the connection member to the induction cover, the upper and lower displacement measuring rods being successively inserted into the penetration holes; and a supporting plate positioned at a top of the induction cover and having an insertion rod for sealing top ends of the upper and lower displacement measuring rods.

13. The apparatus of claim 12, wherein said upper and lower displacement rods are hollow rods.

14. The apparatus of claim 12, wherein said induction cover is cylindrical in shape.

15. A supporting force measuring method for use in an apparatus for measuring a supporting force of ferroconcrete piles installed at a scene by means of a bi-directional front end oil pressure loading apparatus using a high pressure loading system, said method comprising the steps of:

forming a hole in a ground, said hole having a predetermined size and depth;

installing the apparatus for measuring the supporting force in the hole;

providing a tremie tube into which the bi-directional front end oil pressure loading apparatus is inserted;

pouring concrete into the tremie tube, the concrete being poured into penetration holes via a tremie induction tube positioned at a lower end of the tremie tube;

driving the bi-directional front end oil pressure loading apparatus so that a high oil pressure cylinder is inflated when the concrete is recuperated;

measuring a displacement at upper and lower side faces of the bi-directional front end oil pressure loading apparatus using a displacement measuring rod after inflation of the high oil pressure cylinder, and measuring abrasion of the ground contacted by the concrete; and preparing a load distribution chart using the measured abrasion.

16. The method of claim 15, wherein the measuring step is carried out by using a load transition measuring instrument.

17. A supporting force measuring method for use in an apparatus for measuring a supporting force of ferroconcrete piles installed at a scene by means of a bi-directional front end oil pressure loading apparatus using a high pressure loading system, said method comprising the steps of:

(a) providing a load sensor coupled to upper and lower discs of the apparatus;

(b) measuring values derived by the load sensor for each loading;

(c) calculating a piles column face abrasion at a predetermined loading using the measured values from the load sensor;

(d) deriving a distribution chart according to a depth;

(e) calculating a size of the abrasion with respect to a same upward load as a sinking amount at a predetermined downward loading from the distribution chart;

(f) successively calculating a total abrasion distribution chart by directionally converting abrasion distributions on the lower of the upper and lower discs after the abrasion distribution on the lower of the upper and lower discs with respect to the downward loading is combined with an abrasion distribution on the upper of the upper and lower discs with respect to an upward loading;

(g) deriving an axis load distribution chart at a predetermined loading by addition of a component of a front end supporting force of piles derived in step (c);

(h) repeatedly carrying out the steps (b) thru (g); and (i) completing derivation of the axis load distribution chart with regard to a representative loading step.

* * * * *